US006082911A

United States Patent [19]

Murakami

[11] Patent Number: 6,082,911

[45] Date of Patent: Jul. 4, 2000

[54] METHOD FOR JUDGING PROPRIETY OF PRINTING POSITION AND PRINTING APPARATUS

[75] Inventor: Atsushi Murakami, Nagoya, Japan

[73] Assignee: Brother Kogyo Kabushiki Kaisha, Nagoya, Japan

[21] Appl. No.: 09/082,153

[22] Filed: May 21, 1998

[30] Foreign Application Priority Data

May 23, 1997 [JP] Japan ..... 9-133147

[51] Int. Cl.[7] ..... B41J 3/42

[52] U.S. Cl. ..... 400/74; 400/279; 400/282; 400/283

[58] Field of Search ..... 400/74, 282, 279, 400/283; 347/19, 179

[56] References Cited

U.S. PATENT DOCUMENTS

| | | | |
|---|---|---|---|
| 5,069,556 | 12/1991 | Sasaki et al. | 400/74 |
| 5,250,956 | 10/1993 | Haselby et al. | 346/1.1 |
| 5,388,517 | 2/1995 | Levien | 101/485 |
| 5,534,895 | 7/1996 | Lindenfelser et al. | 347/19 |
| 5,600,350 | 2/1997 | Cobbs et al. | 347/19 |
| 5,610,639 | 3/1997 | Takada et al. | 347/19 |
| 5,796,414 | 8/1998 | Sievert et al. | 347/19 |
| 5,831,658 | 11/1998 | Iga et al. | 347/171 |
| 5,917,511 | 6/1999 | Ueda | 347/19 |
| 5,940,093 | 8/1999 | Bolash et al. | 347/16 |

*Primary Examiner*—John S. Hilten
*Assistant Examiner*—Charles H. Nolan, Jr.
*Attorney, Agent, or Firm*—Oliff & Berridge, PLC

[57] ABSTRACT

A reference pattern is printed on one of the printing regions as the printing head moves in one direction, and a comparison pattern, which is to become a pattern identical to the reference pattern, is printed on the other of the printing regions as the printing head moves in both directions. A judging process is provided in which the comparison pattern is compared with the reference pattern so as to judge whether the two patterns are identical or not. The relative positional relation is determined to be proper if the two patters have been judged to be identical.

26 Claims, 15 Drawing Sheets

| IDENTIFICATION NUMBER | CORRECTION AMOUNT |
|---|---|
| No. 1 | +4 |
| No. 2 | +3 |
| No. 3 | +2 |
| No. 4 | +1 |
| No. 5 | 0 |
| No. 6 | −1 |
| No. 7 | −2 |
| No. 8 | −3 |
| No. 9 | −4 |

METHOD FOR JUDGING PROPRIETY OF PRINTING POSITION AND PRINTING APPARATUS

BACKGROUND OF THE INVENTION

1. Field of the Invention

The present invention relates to a method of judging a propriety of a printing position of a printing head, which is designed to reciprocate and print in both directions of the reciprocation on a recording sheet, and a printing apparatus for carrying out this method. In particular, the present invention relates to a method of judging a propriety of a relative positional relation between the printing operation in the forward direction and the printing operation in the backward direction performed by the printing head, and a printing apparatus for carrying out this method.

2. Description of the Related Art

For example, in a printing apparatus having an ink-jet type or wire-dot type printing head, during a printing operation, as a recording sheet is sent or fed intermittently to a prescribed direction, the printing head moves back and forth in a direction perpendicular to the direction in which the recording sheet is sent. In this way, the printing head performs a desired printing operation on the entire printing region on the recording sheet.

In order to improve the printing operation efficiency, the printing head is designed to print in both of the directions of the reciprocation (i.e. forward and backward directions). In this case, the relative positional relation between the printing operation in the forward direction and the printing operation in the backward direction by the printing head needs to be set properly. When the relative positional relation is not properly set, a discrepancy arises between the printing operation in the forward direction and the printing operation in the backward direction. In this case, for example, when a vertical ruled line is printed across several lines or horizontal rows, the vertical ruled line does not turn out to be a straight line. In an extreme case, the vertical ruled line appears as several vertical ruled lines which are displaced or shifted from each other with respect to the direction of the motion of the printing head.

However, it is relatively difficult to set properly the relative positional relation between the printing operation in the forward direction and the printing operation in the backward direction. This difficulty is primarily caused by the fact that the printing head keeps on moving during the printing operation. Since a gap must always exist between the printing head and the recording sheet, there is always a time difference between the timing at which the printing head starts printing and the timing at which the printing is finished on the recording sheet. This time difference also contributes to this difficulty. In addition, the gap between the printing head and the recording sheet varies due to the dimension errors that parts containing the printing head have, an irregularity of the installation position of the printing head, the thickness of the recording sheet being used, or the like. This gap also contributes to this difficulty.

For example, the ink-jet type printing head will be explained more specifically. When the printing head injects ink, the ink reaches the recording sheet after some time interval or delay. Since the printing head is moving during the printing operation, the actual printing position on the recording sheet is shifted forward in the direction of the motion of the printing head with respect to the position at which the printing head has injected the ink. This shift amount is determined by the velocity of the moving printing head, the size of the gap between the printing head and the recording sheet, and the injection speed of the ink that travels this gap. Of these determining factors, the size of the gap between the printing head and the recording sheet varies depending on the errors contained in the parts or components, the irregularity in the installment position of the printing head, or the thickness of the recording sheet being used. This variation of the size of the gap also causes the shift amount to vary.

In addition, as has been explained above, this shift is generated on the forward side in the direction of the motion of the printing head with respect to the position at which the printing head has actually injected the ink. Therefore, it is to be noted that the side toward which the printing position shifts when the printing head moves in the forward direction is opposite to the side toward which the printing position shifts when the printing head moves in the backward direction. As a result, for example, if the shift amount varies by a specific amount due to the variation of the size of the gap between the printing head and the recording sheet, the magnitude of this variation appears as twice that of the shift amount variation, when the shift amount is viewed between the printing operation in the forward direction and the printing operation in the backward direction.

Under these circumstances, before a printing apparatus having a printing head that moves backward and forward is shipped, the propriety of the relative positional relation between the printing operation in the forward direction and the printing operation in the backward direction is judged. If the relative positional relation has been judged to be improper, the relative positional relation is adjusted so as to become proper. This adjustment is performed by changing the amount of delay between the timing at which the motion of the printing head starts and the timing at which the printing head starts printing.

Moreover, at the above-mentioned pre-shipment stage, even if the relative positional relation between the printing operation in the forward direction and the printing operation in the backward direction is properly adjusted, this relative positional relation can start to become improper while the printing apparatus is being used. For example, at the pre-shipment stage, the relative positional relation is adjusted and set properly using a recording sheet having a standard thickness. However, in the case in which the user uses a recording sheet of a non-standard thickness, or though it occurs rarely, in the case in which the installation position of the printing head has moved due to some factors, or the like, this relative positional relation needs to be re-adjusted.

In adjusting the relative positional relation at each of these stages, the actual printing is performed on a recording sheet. Based on this printing result, an adjustment value that will eliminate the discrepancy between the printing operation in the forward direction and the printing operation in the backward direction is determined. Based on this adjustment value, the delay amount between the timing at which the printing head starts moving and the timing at which the printing head starts printing is changed. This method is adopted in adjusting the relative positional relation. In order to determine the adjustment value that will eliminate the discrepancy between the printing operation in the forward direction and the printing operation in the backward direction based on this printing result as described above, the propriety of the relative positional relation between the printing operation in the forward direction and the printing operation in the backward direction needs to be judged by a visual observation. In order to render this judgment, the following method is adopted.

Namely, as shown in FIG. 21, by carrying out the actual printing, for example, three horizontal rows (i.e. three lines) of vertical ruled line patterns are formed on a recording sheet. More specifically, in the first row (i.e. the top row), multiple vertical ruled lines 1 are printed along a direction indicated by an arrow 2. Next, after the row is changed as shown by an arrow 3 (i.e., after a line feed is performed), the printing direction is changed as shown by an arrow 4. The same number of multiple vertical ruled lines 5 are then printed in the second row (i.e. the middle row). After the row is changed again as shown by an arrow 6 (i.e., after the line feed is performed again), as shown by the arrow 2, the same number of multiple vertical ruled lines 7 are printed in the third row (i.e. the bottom row) in the same printing direction as the first row.

In these ruled line patterns, if the vertical ruled lines 1 in the first row, the vertical ruled lines 5 in the second row, and the vertical ruled lines 7 in the third row are all collinear, the relative positional relation between the printing operation in the forward direction and the printing operation in the backward direction is judged to be proper. In FIG. 21, since the vertical ruled lines 1, 5 and 7 are not collinear, the relative positional relation between the printing operation in the forward direction and the printing operation in the backward direction is judged to be improper. Therefore, an adjustment value is selected so that these vertical ruled lines 1, 5 and 7 will become collinear. In accordance with this adjustment value, for example, the delay amount between the timing at which the printing head starts moving and the timing at which the printing head starts printing is changed and corrected.

In judging the propriety of the above-described printing positions, judgment patterns that have actually printed are visually observed by a human.

However, it is extremely difficult to judge the propriety of the printing positions by such a visual observation using the above-described ruled line patterns shown in FIG. 21. In FIG. 21, the state in which the relative positional relation between the printing operation in the forward direction and the printing operation in the backward direction is improper is exaggerated for the sake of explanation. Therefore, the sizes of the displacements among the vertical ruled lines 1, 5 and 7 are shown quite large. However, in reality, in order to judge the propriety of the relative positional relation, it must be judged whether the vertical ruled lines 1, 5 and 7 are collinear even if, for example, these vertical ruled lines are displaced by the thickness or width of the vertical ruled line. Hence, it is extremely difficult for the visual observer to judge confidently the propriety with a high degree of accuracy.

In addition, the following problems also arise in judging the propriety of the printing positions using the above-described ruled line patterns. These problems will be explained with reference to FIGS. 22, 23 and 24, respectively. In FIGS. 22, 23 and 24, the same elements as those in FIG. 21 carry the same reference numerals, and the explanations thereof are omitted.

FIG. 22 illustrates a printing example of ruled line patterns which are generated when the printing head is inclined in the direction of the motion of the printing head. Under this circumstance, the ruled lines 1, 5 and 7 cannot become collinear. Hence, it is impossible to even select an adjustment value that will make the ruled lines 1, 5 and 7 collinear.

FIG. 23 illustrates a printing example of ruled line patterns when the head surface of the printing head is not parallel to the recording surface. In this case, the ruled lines 1, 5 and 7 can be connected to form a single line. An adjustment value for creating this state exists. However, even though the ruled lines 1, 5 and 7 are connected forming a single line, the line is not a straight line. Therefore, it is extremely difficult to judge this state.

FIG. 24 illustrates a printing example of ruled line patterns in the case in which the velocity of the motion of the printing head has changed. Under this circumstance, some of the multiple vertical ruled lines 1 become collinear with some of the corresponding multiple vertical ruled lines 5 and 7, and the remainder of the multiple vertical ruled lines 1 do not become collinear with the corresponding multiple vertical ruled lines 5 and 7. Therefore, it is extremely difficult to judge the propriety of the relative positional relation.

SUMMARY OF THE INVENTION

Under these circumstances, it is an object of the present invention to provide a method of judging a propriety of a printing position, which can solve the above-stated various problems and a printing apparatus for carrying out this method.

(1) The above object of the present invention can be achieved by a first method of judging a propriety of a relative positional relation between a printing operation in a forward direction and a printing operation in a backward direction on a recording sheet when a printing head of reciprocating type prints in both of the forward and backward directions. The first method has: a printing process of printing a reference pattern on one of two printing regions adjacent to each other on the recording sheet, as the printing head moves in one of the forward and backward directions, and printing a comparison pattern, which is to become identical to the reference pattern, on the other of the two printing regions as the printing head moves in both of the forward and backward directions; and a judging process of comparing the printed comparison pattern with the printed reference pattern, judging whether or not the printed comparison pattern is substantially identical to the printed reference pattern on the basis of a predetermined criterion, and judging that the relative positional relation is proper if the printed comparison pattern is judged to be substantially identical to the printed reference pattern.

According to the first method of the present invention, a comparison pattern that is to become identical to a reference pattern, which is printed as the printing head moves in one of the forward and backward directions, is printed as the printing head moves in both of the forward and backward directions. Therefore, the information as for the relative positional relation between the printing operation in one direction and both directions appears in the comparison pattern. However, if the relative positional relation is proper, the comparison pattern becomes identical to the reference pattern. Therefore, when the comparison pattern is compared with the reference pattern, if the two patterns are judged to be substantially identical on the basis of a predetermined criterion, the relative positional relation is judged to be proper.

In this manner, since (i) the reference pattern is printed on one of the printing regions as the printing head moves in one direction, and the comparison pattern, which is to become a pattern identical to the reference pattern, is printed on the other of the printing regions as the printing head moves in both directions, (ii) the comparison pattern is then compared with the reference pattern so as to judge whether the two patterns are identical or not, and (iii) the relative positional relation is determined to be proper if the two patters have been judged to be identical, the accuracy and reliability of the judgment by human eyes can be improved as compared with the case in which a single pattern is judged absolutely. In addition, since the comparison pattern can be printed at a position adjacent to or at the vicinity of the reference pattern, the abovedescribed comparison can be easily carried out.

(2) The above object of the present invention can be also achieved by a second method of judging a propriety of a relative positional relation between a printing operation in a forward direction and a printing operation in a backward direction on a recording sheet when a printing head of reciprocating type prints in both of the forward and backward directions. The method has: a printing process of printing a reference pattern on one of two printing regions adjacent to each other on the recording sheet, as the printing head moves in one of the forward and backward directions, and printing a comparison pattern, which is to become identical to the reference pattern, on the other of the two printing regions as the printing head moves in both of the forward and backward directions, said printing process being repeatedly performed for a plurality of pairs of the reference pattern and the comparison pattern respectively as the relative positional relation is gradually changed; and a judging process of comparing the printed comparison pattern with the printed reference pattern for each of the pairs, selecting one of the pairs in which the printed comparison pattern optimally approximates the printed reference pattern, and judging that the relative positional relation of the selected one of the pairs is proper.

According to the second method of the present invention, when these printing process and judging process are carried out, in the judging process, the pair in which the comparison pattern optimally approximates the reference pattern is selected from among the multiple pairs of the reference pattern and the comparison pattern which have been printed in one printing process. In correspondence with the selected pair, the adjustment value is set for adjusting or correcting the relative positional relation.

In this manner, since (i) in one series of the printing process, the multiple pairs of the reference pattern and the comparison pattern are printed, while gradually changing the relative positional relation, (ii) in the judging process, the comparison pattern is compared with the reference pattern in each of the multiple pairs, (iii) a pair in which the comparison pattern optimally approximates the reference pattern is then selected, and (iv) the relative positional relation of the selected pair is then determined to be proper, a proper adjustment value can be quickly selected.

(3) In one aspect of the second method of the present invention, in the printing process, the pairs are printed on one sheet of the recording sheet such that each of the pairs is printed on respective one of lines on said one sheet while a line feed is performed on said one sheet for each of the pairs.

When this printing process is carried out, the multiple pairs of the reference pattern and the comparison pattern are printed on one sheet of the recording sheet. Therefore, in the judging process, the pair having the optimal relative positional relation can be selected while observing the single sheet of the recording sheet.

In this manner, since, in the above-described printing process, the multiple pairs of the reference pattern and the comparison pattern are printed on one sheet of the recording sheet while changing the row for each of the pairs, in the judging process, the comparison pattern can be easily compared with the reference pattern in each of the pairs by a visual observation.

(4) According to one aspect of the first method or another aspect of the second method of the present invention, the comparison pattern includes a pattern in which a portion that is printed as the printing head moves in the backward direction is completely superposed onto a portion that is printed as the printing head moves in the forward direction if the relative positional relation is proper.

According to this comparison pattern, if the relative positional relation is improper, the lines thicker or wider than those contained in the reference pattern or double lines are printed as the comparison pattern.

In this manner, since the comparison pattern includes a pattern in which a portion that is printed as the printing head moves in the backward direction is completely superposed onto a portion that is printed as the printing head moves in the forward direction, if the relative positional relation is improper, the lines thicker than those contained in the reference pattern or the double lines are printed, making the comparison of the two patterns easy.

(5) In another aspect of the first or second method of the present invention, both of the reference pattern and the comparison pattern yield a series of vertical ruled lines.

When the shapes of the reference pattern and the comparison pattern are selected in this way, if the relative positional relation is proper, both of the reference pattern and the comparison pattern yield a series of vertical ruled lines of uniform thickness. On the other hand, if the relative positional relation is improper, only in the portion of the vertical ruled lines, which corresponds to the comparison pattern, the thick or double lines appear.

In this manner, since both of the reference pattern and the comparison pattern yield one series of the vertical ruled lines, if the relative positional relation is proper, both of the reference pattern and the comparison pattern yield one series of the vertical ruled lines in uniform thickness, or if the relative positional relation is improper, only in the portion that corresponds to the comparison pattern, the thick lines or the double lines appear, so that the propriety of the relative positional relation can be judged correctly more easily. In the case in which the printing head is inclined in the direction of the motion of the printing head also, as well as in the case in which the head surface of the printing head is not parallel to the recording surface, the comparison pattern can be compared with the reference pattern without any problem.

(6) In this aspect of the first or second method of the present invention, in the printing process, when printing the reference pattern, a first color and a second color distinct from each other may be printed to be superposed with each other as the printing head moves in one of the forward and backward directions. And that, when printing the comparison pattern, the first color may be printed as the printing head moves in the forward direction, and the second color may be printed as the printing head moves in the backward direction.

If the multiple printing colors are used in this manner, the first color and the second color are printed to be superposed on each other in the reference pattern. On the other hand, in the comparison pattern, if the relative positional relation is proper, as in the reference pattern, the first color and the second color are printed to be superposed on each other. However, if the relative positional relation is improper, the first color and the second color appear individually at least partially. Therefore, the propriety of the relative positional relation can be judged by the color difference between the color in the reference pattern and the color in the comparison pattern.

Incidentally, as a combination of the above-described first and second colors, a combination of cyan and magenta is preferably used.

In this manner, since (i) in printing the reference pattern, the first color and the second color that is distinct from the first color are blended as the printing head moves in one direction, (ii) in printing the comparison pattern, the first color is printed as the printing head moves in the forward direction, and (iii) the second color is printed as the printing head moves in the backward direction, the second color is superposed on the first color in the reference pattern. On the other hand, since (i) in the comparison pattern, if the relative positional relation is proper, as in the reference pattern, the first color and the second color are blended, and (ii) if the relative positional relation is improper, the first color and the second color appear individually. Therefore, the propriety of the relative positional relation can be judged by the color difference between the reference pattern and the comparison pattern also. As a result, the accuracy and reliability of the judgment can be improved.

(7) According to another aspect of the first or second method of the present invention, in the printing process, when printing the reference pattern, a first color and a second color distinct from each other are printed to be adjacent to each other as the printing head moves in one of the forward and backward directions; and when printing the comparison pattern, the first color is printed as the printing head moves in the forward direction, and the second color is printed as the printing head moves in the backward direction.

Thus, in printing the reference pattern, when the first color is juxtaposed with the second color, in the comparison pattern, if the relative positional relation is proper, a pattern identical to the reference pattern appears in the state in which the first color is juxtaposed with the second color. However, if the relative positional relation is improper, the first color overlaps at least a portion of the second color, or the gap between the first and second colors in the comparison pattern differs from that in the reference pattern. Therefore, the propriety of the relative positional relation can be judged by the color difference between the reference pattern and the comparison pattern or by the degree with which the colors are blended, or the like also.

In this manner, since (i) when printing the reference pattern, as a first color is printed, the first color is juxtaposed with a second color that is distinct from the first color as the printing head moves in one direction, and (ii) when printing the comparison pattern, the first color is printed as the printing head moves in the forward direction, and the second color is printed as the printing head moves in the backward direction, a pattern identical to the reference pattern appears in a state in which the first color is juxtaposed with the second color in the comparison pattern, if the relative positional relation is proper. However, if the relative positional relation is improper, the first color overlaps at least a portion of the second color, or the gap between the first and second colors in the comparison pattern differs from that in the reference pattern. Therefore, the propriety of the relative positional relation can be judged by the color difference between the reference pattern and the comparison pattern or by the degree with which the colors are blended also. As a result, the accuracy and reliability of the judgment can be improved.

(8) In another aspect of the first or second method of the present invention, each of the reference pattern and the comparison pattern includes a pattern on which a plurality of dots are distributed, dots which are included in the comparison pattern being classified into dots in a first group and dots in a second group, the dots in the first group and the dots in the second group being arranged alternately so that each of the dots in the first group is positioned between the dots in the second group and each of the dots in the second group dots is positioned between the dots of the first group, and when printing the comparison pattern, the dots in the first group are printed as the printing head moves in the forward direction and the dots in the second group are printed as the printing head moves in the backward direction.

The above-described reference pattern typically displays a thin gray color. If the relative positional relation is proper, the comparison pattern also displays a thin gray color. Therefore, if the reference pattern and the comparison pattern display the same pattern with the same concentration, the relative positional relation is judged to be proper. On the other hand, if the relative positional relation is improper, the comparison pattern displays a pattern or concentration that is different from the pattern or concentration of the reference pattern displays.

In this manner, since (i) the reference pattern and the comparison pattern include a pattern in which the multiple dots are distributed, (ii) the dots included in the comparison pattern are classified into the first group dots and the second group dots, (iii) the first group dots and the second group dots are arranged alternately so that the first group dots are positioned between the second group dots, and the second group dots are positioned between the first group dots, and (iv) the first group dots are printed as the printing head moves in the forward direction while the second group dots are printed as the printing head moves in the backward direction when the comparison pattern is printed, if the reference pattern and the comparison pattern display the same pattern with the same concentration, the relative positional relation is judged to be proper. On the other hand, if the comparison pattern displays a pattern or concentration that is different from the pattern or concentration the reference pattern displays, the relative positional relation is judged to be improper. In addition, the overall display of the comparison pattern is compared with that of the reference pattern on a surface having a prescribed area. Therefore, a visual judgment can be rendered with a high degree of accuracy. Moreover, since the overall display of the comparison pattern is compared with that of the reference pattern on a surface having a prescribed area, even if the velocity of the motion of the printing head is changed, a judgment can be rendered easily.

(9) In another aspect of the first or second method of the present invention, in the printing process, both of the two printing regions are positioned within a printing range of a single line of the printing head, and the comparison pattern is printed as the printing head moves in both of the forward and backward directions without a line feed.

When the printing process is performed in this aspect, both of the reference pattern and the comparison pattern can be positioned within the printing range of the single line of the printing head.

In this manner, since (ii) in the printing process, both of the first and second printing regions are accommodated within the printing range of the single row of the printing head, and (ii) the C) comparison pattern is printed as the printing head moves in both directions without changing the row, both of the reference pattern and the comparison pattern can be accommodated within the printing range of the single row of the printing head. As a result, the printing area or recording sheet can be saved. Moreover, the multiple judgment patterns can be printed on the single sheet of the recording sheet also.

(10) In this aspect of the first or second method of the present invention, in the printing process, the reference pattern and a portion of the comparison pattern may be printed as the printing head moves in one of the forward and backward directions, and a remaining portion of the comparison pattern may be printed as the printing head moves in the other of the forward and backward directions. If the printing process is carried out in this way, both of the reference pattern and the comparison pattern can be printed as the printing head moves backward and forward just once.

In this manner, since (i) in the printing process, a portion of the reference pattern and a portion of the comparison pattern are printed as the printing head moves in one direction, and (ii) the remaining portion of the comparison pattern is printed as the printing head moves in the other direction, both of the reference pattern and the comparison pattern can be printed as the printing head moves back and forth once. As a result, the printing operation for judging the propriety of the printing position can be carried out efficiently.

(11) In another aspect of the first or second method of the present invention, in the printing process, a plurality of kinds of pairs of the reference pattern and the comparison pattern are printed.

If the printing process is carried out in this way, in the judging process, the comparison pattern is compared with the reference pattern in each of the multiple kinds of pairs.

Incidentally, in the case in which the multiple kinds of pairs of the reference pattern and the comparison pattern are printed, it is desirable that these multiple kinds of pairs be printed so as to line up along the direction of the motion of the printing head, that is, the horizontal row direction. It is even more desirable that these multiple kinds of pairs be accommodated within the printing range of the single row of the printing head.

In this manner, since in the printing process, the multiple kinds of pairs of the reference pattern and the comparison pattern are printed, the characteristics of each kind of comparison pattern and reference pattern can be exploited in performing the comparison in the judging process. As a result, the accuracy of the printing position propriety judgment can be further improved. Moreover, in the case in which the multiple kinds of pairs of the reference pattern and the comparison pattern are printed, these multiple kinds of pairs are printed so as to line up along the direction of the motion of the printing head. If these multiple kinds of pairs are accommodated within the printing range of the single row of the printing head, then the efficiency of the printing operation can be improved, and the printing area can be saved.

(12) In another aspect of the first or second method of the present invention, one of the two printing regions on which the reference pattern is printed and the other of the tow printing regions on which the comparison pattern is printed are positioned through a boundary that extends along a direction of a motion of the printing head.

When the two printing regions have been printed in this way, if the row direction is visually observed horizontally, then the comparison pattern is compared with the reference pattern vertically.

In this manner, since the printing region on which the reference pattern is printed is separated from the printing region on which the comparison pattern is printed through a boundary that extends along the direction of the motion of the printing head, if the row direction is visually observed horizontally, the comparison pattern can be compared with the reference pattern vertically.

(13) In another aspect of the first or second method of the present invention, wherein, one of the two printing regions on which the reference pattern is printed and the other of the two printing regions on which the comparison pattern is printed are positioned to be arranged along a direction of a motion of the printing head.

When the two printing regions have been printed in this way, if the row direction is visually observed horizontally, then the comparison pattern is compared with the reference pattern horizontally.

Incidentally, this aspect can be combined with the above mentioned aspect in which the two printing regions are positioned through the boundary. In such a combination, the printing region on which the reference pattern is printed and the printing region on which the comparison pattern is printed line up not only along the direction of the motion of the printing head, but also along the direction orthogonal to this motion direction.

In this manner, since the printing region on which the reference pattern is printed and the printing region on which the comparison pattern is printed are positioned so as to line up along the direction of the motion of the printing head, if the row direction is visually observed horizontally, the comparison pattern can be compared with the reference pattern horizontally.

(14) The present invention is also applied to a printing apparatus for executing the above-described method of judging the propriety of the printing position.

Namely, the above object of the present invention can be achieved by a first printing apparatus provided with: a printing head for printing in both of forward and backward directions; a moving device for moving the printing head so as to reciprocate in the forward and backward directions with respect to a recording sheet; and a printing control device for controlling the printing head and the moving device to print a reference pattern on one of two printing regions adjacent to each other on the recording sheet, as the printing head moves in one of the forward and backward directions, and print a comparison pattern, which is to become identical to the reference pattern, on the other of the two printing regions as the printing head moves in both of the forward and backward directions, when an order to perform a printing operation for judging a propriety of a printing position is given.

According to the first printing apparatus of the present invention, in response to the order to perform the printing operation for judging the propriety of the printing position, the printing process as described in the first method of the present invention can be executed.

In this manner, since the printing control device controls to print the reference pattern on one of the printing regions as the printing head moves in one direction and print the comparison pattern that is to become a pattern identical to the reference pattern on the other of the printing regions as the printing head moves in both directions when an order to execute the printing operation for the judgment of the propriety of the printing position is given, a printing process like the one described in the first method of the present invention can be executed in response to the order.

(15) The above object of the present invention can be also achieved by a second printing apparatus provided with: a printing head for printing in both of forward and backward directions; a moving device for moving the printing head so as to reciprocate in the forward and backward directions with respect to a recording sheet; and a printing control device for controlling the printing head and the moving device to print a reference pattern on one of two printing regions adjacent to each other on the recording sheet, as the printing head moves in one of the forward and backward directions, and print a comparison pattern, which is to become identical to the reference pattern, on the other of the two printing regions as the printing head moves in both of the forward and backward directions such that printing are repeatedly performed for a plurality of pairs of the reference pattern and the comparison pattern respectively as a relative positional relation between a printing operation in the forward direction and a printing operation in the backward direction is gradually changed, when an order to perform a printing operation for judging a propriety of a printing position of the printing head is given.

According to the second printing apparatus of the present invention, in response to the order to perform the printing operation for judging the propriety of the printing position, the printing process as described in the second method of the present invention can be executed.

In this manner, since the printing control device controls to print the reference pattern on one of the printing regions as the printing head moves in one direction, print the comparison pattern on the other of the printing regions as the printing head moves in both directions, and repeat printing the multiple pairs of the reference pattern and the comparison pattern while gradually changing the relative positional relation between the printing operation in the forward direction and the printing operation in the backward direction when an order to execute the printing operation for the judgment of the propriety of the printing position is given, the printing process like the one described in the second method of the present invention is carried out when the order is given.

(16) In one aspect of the second printing apparatus of the present invention, the printing control device controls the printing head and the moving device to print an identification code for each of the plurality of pairs to distinguish the plurality of pairs from each other, and the printing apparatus further comprises a correction device for correcting the printing position for the forward and backward directions, when values corresponding to the identification codes are specified, on the basis of the specified values.

According to this configuration, of the multiple pairs of the reference pattern and the comparison pattern, a pair to be selected can be distinguished by its identification code. In addition, after the correction device has corrected the printing position of the printing head, the corrected printing apparatus can carry out the subsequent printing operations.

In this manner, since (i) the printing control device controls to print the identification code for each of the plurality of pairs of the reference pattern and comparison pattern so as to distinguish the multiple pairs from each other, and (ii) the correction device corrects the printing position of the printing head as the printing head in both of the forward and backward directions on the basis of the values when the values that correspond to the identification codes of the multiple pairs are designated, one pair from among the multiple pairs to be selected can be distinguished by its identification code. In addition, after the correction device corrects the printing position of the printing head, the subsequent printing operation can be carried on the basis of the corrected printing position.

The nature, utility, and further features of this invention will be more clearly apparent from the following detailed description at with respect to preferred embodiments of the invention when read in conjunction with the accompanying drawings briefly described below.

DETAILED DESCRIPTION OF THE PREFERRED EMBODIMENT

Figure 16:
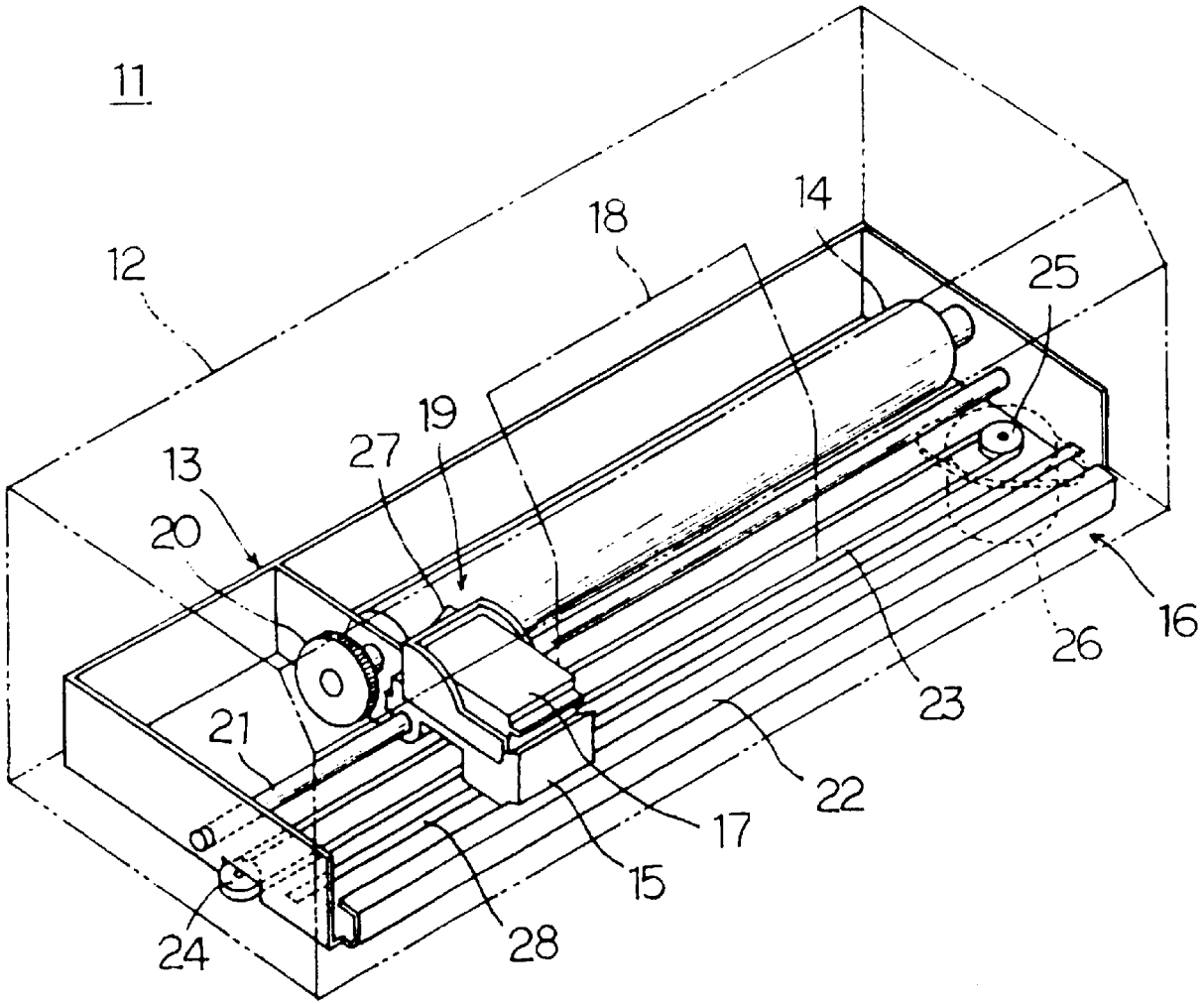
FIG. 16 is a perspective view showing the main unit of a printing apparatus 11 having an ink jet type printing head 27.

First, as an example of a printing apparatus to which the method of judging the propriety of the printing position according to the present invention can be applied, an ink jet printing apparatus 11 shown in FIG. 16 will be explained. The ink jet printing apparatus 11 has a main body cover 12 shown by the imaginary lines. A main body frame 13 is installed inside the main body cover 12. This printing apparatus 11 has as its basic components a platen 14, a carriage 15, a carriage driving mechanism 16 for driving the carriage 15, and an ink injecting mechanism 19 for injecting recording ink stored in an ink cartridge 17 toward a recording sheet 18. The main body frame 13 holds these components directly or indirectly.

The main body frame 13 supports both ends of the platen 14 so that the platen 14 can be rotated. A platen gear 20 is attached to the left end of the platen 14 shown in FIG. 16. The rotation of a feed motor is transmitted to this platen gear 20 via a gear sequence not shown in the drawing. As a result, the platen 14 rotates so as to send the recording sheet 18 to a prescribed direction.

A guide rod 21 supports one side of the carriage 15 that is close to the platen 14. A guide rail 22 supports the other side of the carriage 15 that is far from the platen 14. In this way, the carriage 15 can be moved along the direction of the axis of the platen 14. The main body frame 13 supports the guide rod 21. The guide rail 22 constitutes a portion of the main body frame 13.

The carriage 15 fixes a prescribed portion of an endless belt 23 on the bottom surface side of the carriage 15. The endless belt 23 is strapped between pulleys 24 and 25 which are installed on both ends of the main body frame 13 so that the endless belt 23 will be stretched parallel to the guide rod 21 and guide rail 22. The pulley 25 is installed on the driving axis of a carriage driving motor 26 that is constituted of, for example, a stepping motor. Therefore, when the carriage driving motor 26 is driven, the carriage 15 is moved back and forth in a desired direction along the guide rod 21 and guide rail 22 via the pulley 25 and the endless belt 23.

A printing head 27 is installed on this carriage 15. The printing head 27 is an ink jet head which injects the ink inside an ink chamber (not shown in the drawing), which accommodates the ink supplied from the ink cartridge 17, from its nozzle toward the recording sheet 18 and prints by changing the capacity of the ink chamber using a piezoelectric device or the like. This printing head 27 may be an ink jet head for handling the liquid ink from the beginning or a hot melt type ink jet head, which heats up and melts a solid ink pellet into the liquid ink.

An encoder scale 28 is installed along the moving path of the carriage 15. Optically readable slits not shown in the drawing are formed on the encoder scale 28. These slits are distributed along the longitudinal direction of the encoder scale 28. The density of these slits is set to, for example, 90 slits per inches. On the other hand, an encoder device 29 (see FIG. 18) is installed on the carriage 15. This encoder device 29 reads out the slits on the encoder scale 28, and generates an encoder signal that corresponds to the velocity of the carriage 15. In other words, the number of the pulses contained in the encoder signal corresponds to the number of the read out slits, and the pulse period of the encoder signal corresponds to the interval between the slits. This encoder device 29 has, for example, a photo-coupler that is constituted of two pairs of light emitting devices and two pairs of light receiving devices. A phase difference equal to ¾ period is given between the two light emitting devices and between the two light receiving devices respectively. The encoder device detects the direction of the motion of the carriage 15 from the phase difference between the pulses emitted from the two light receiving devices.

Figure 17:
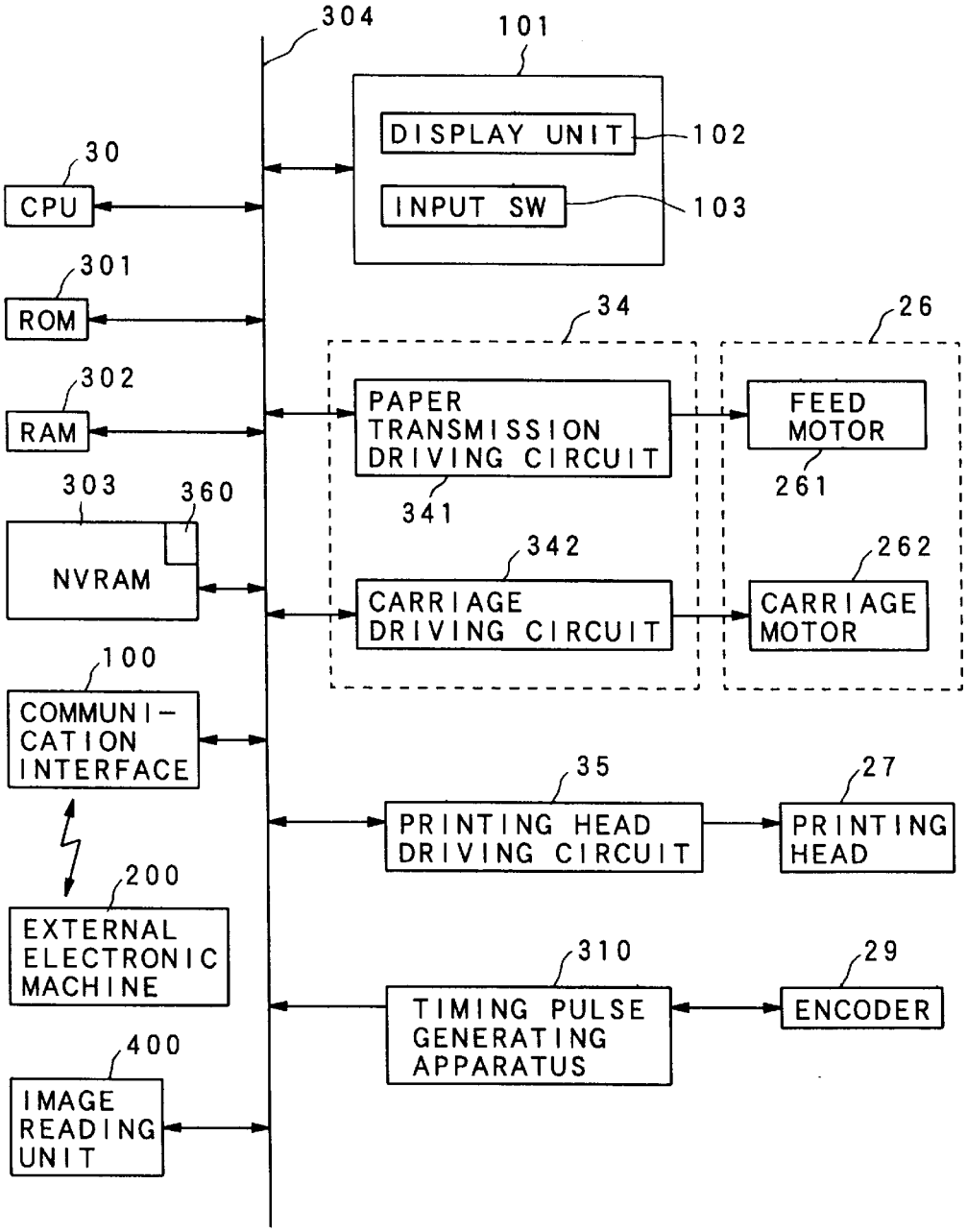
FIG. 17 is a block diagram explaining the control system of the printing apparatus 11 shown in FIG. 16.

The block diagram of FIG. 17 shows the control system of the ink jet printing apparatus 11.

In FIG. 17, a CPU 30 is connected via a bus 304, such as a data bus or address bus or the like, to a communication interface unit 100, an operation panel 101, a driving circuit 34, a head driving circuit 35, a timing pulse generating apparatus 310, an image read out unit 400, a ROM 301, a RAM 302, a non-volatile memory (RAM) 303, or the like. The communication interface unit 100 sends and receives various data to or from an external electronic machine 200. The operation panel 101 is constituted of a display unit 102 having a LCD (Liquid Crystal Display), a display lamp and the like, and an input switch 103. The driving circuit 34 drives the motors which are involved in reading out prints or images. The head driving circuit 35 drives the printing head. The timing pulse generating apparatus 310 generates various kinds of timings based on signals supplied from the encoder device 29. The image read out unit 400 reads out manuscripts such as printed matters or the like using a photoelectric conversion apparatus such as a CCD (Charge Coupled Device) or the like. The ROM 301, RAM 302 and non-volatile memory (RAM) 303 will be explained later.

The ROM 301 stores a reception control program for receiving image data and control data from the external electronic machine 200, a head control program for controlling the driving of a paper transmission driving circuit 341 of the feed motor 261 and a carriage driving circuit 342 of a carriage motor 262 and a printing head driving circuit 35, a program for controlling the display and input to the control panel 101, a program for controlling the image read out unit 400 and taking in the image data, a printing control program for controlling the printing of the image data, a program that is characteristic of the present embodiment, which performs a printing timing correction operation and updates the correction amount, judgment pattern data that is also characteristic of the present embodiment, a correction amount table 36 (FIG. 20), or the like.

Set in the RAM 302 are, a buffer for storing the image data and the control data that the external electronic machine 200 has received and the image data that the image read out unit 400 has read out, various kinds of memories and buffers for controlling the printing operation, and a work area as a provisional memory for executing various processes of the present embodiment.

In addition, areas for various kinds of setting values which the user would wish to store after the power source of the main body of the apparatus has been turned off, for example, an area such as the correction amount memory 360, are set in the non-volatile memory 303. These various values are recorded in the non-volatile memory 303.

Figure 18:
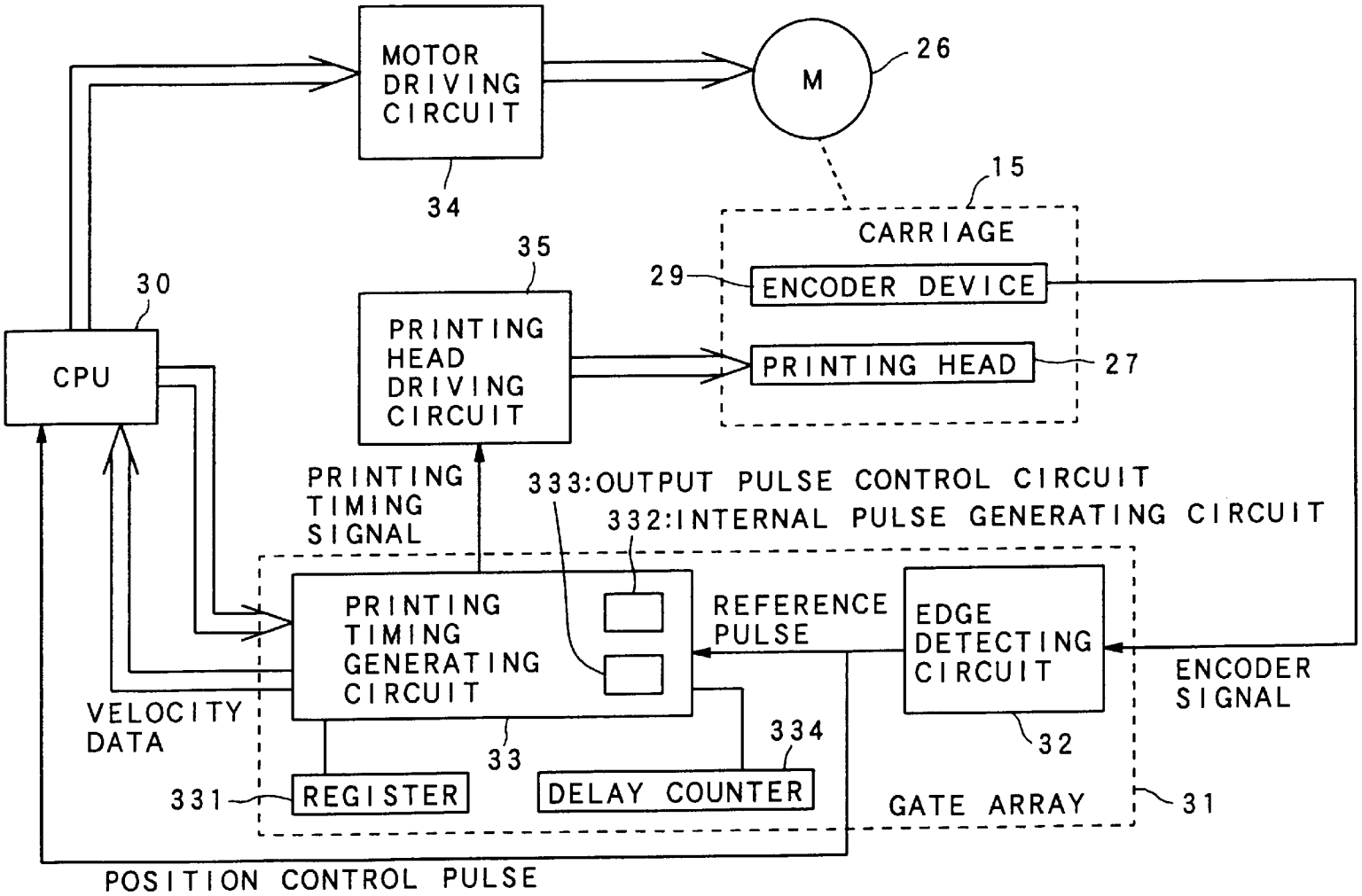
FIG. 18 is a block diagram for explaining in further detail a portion of the control system of the printing apparatus 11 shown in FIG. 16.

FIG. 18 shows in further detail a portion of the control system shown in FIG. 17. The timing pulse generating apparatus 310 shown in FIG. 17 is structured as a gate array 31.

In FIG. 18, the gate array 31 is provided with: an edge detecting circuit 32 which detects the edge of the first transition rise of the encoder signal that has been emitted from the encoder device 29 and generates a reference pulse at the timing of the detection; and a printing timing generating circuit 33 which generates a printing timing signal based on the reference pulse that has been emitted from this edge detecting circuit 32.

The CPU 30 receives velocity data (e.g., the count value of the pulse width of the encoder signal), which has been supplied from the printing timing generating circuit 33, as input data, and calculates the pulse width of a driving signal to be supplied to the motor driving circuit 34 that drives the carriage driving motor 26. The carriage driving motor 26 determines the motion velocity of the carriage 15. In addition, the CPU 30 receives a position control pulse (e.g., the reference pulse), which has been output from the edge detecting circuit 32, as an input, and calculates the current position of the carriage 15. Moreover, the CPU 30 encodes data which as- designates an output pulse selection signal, and permits a printing start signal and a delay count value to be explained later, in a register 331 inside the gate array 31.

The printing timing signal as a timing pulse, which has been output from the printing timing generating circuit 33, is input to the printing head driving circuit 35. In accordance with the timing determined by this printing timing signal, the printing head driving circuit 35 generates a printing head driving pulse that satisfies a pulse width condition and a voltage condition which are required in operating the printing head 27 based on the printing data supplied from the CPU 30. When the printing head 27 receives this printing head driving pulse, the printing head 27 injects ink at a desired timing onto the recording sheet 18 (FIG. 16).

Figure 19:
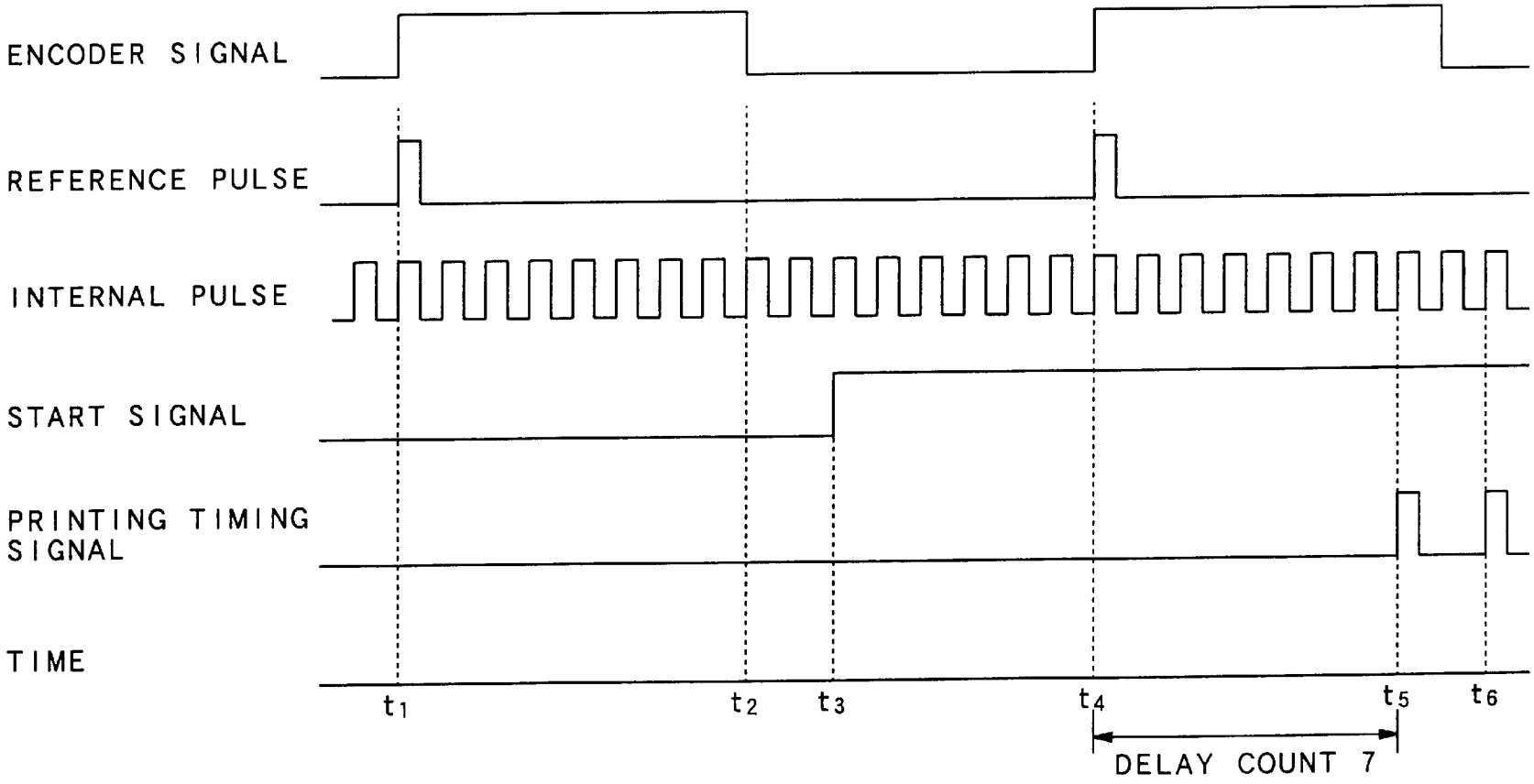
FIG. 19 is a timing diagram for the signals used in the control system shown in FIG. 18.

FIG. 19 shows a timing diagram of the signals which are used in the control system shown in FIG. 18.

In FIG. 19, as has been explained before, the encoder signal is outputted from the encoder device 29 shown in FIG. 18. The period of the encoder signal corresponds to the motion velocity of the carriage 15. The edge detecting circuit 32 detects the edge of the first transition rise of this encoder signal, and generates a reference pulse at the detection timing.

As has been explained before, the printing timing signal is outputted from the printing timing generating circuit 33. The printing timing signal is generated in the printing timing generating circuit 33 in the following manner.

Namely, the printing timing generating circuit 33 has an internal pulse generating circuit 332. First, between two successive first transition rises of the reference pulse, that is, for every one period of the reference pulse, the internal pulse generating circuit 332 generates, for example, sixteen internal pulses. If these sixteen internal pulses are used as a printing timing signal, the maximum achievable printing resolution is 90 dpi×16=1440 dpi. Moreover, with the generation of these internal pulses, the CPU 30 can identify the position of the carriage 15 at a timing that occurs in a shorter length of time than the generation timing of the reference pulse.

The printing timing generating circuit 33 also has an output pulse control circuit 333, which controls the internal pulses so that the printing timing generating circuit 33 will generate one printing timing signal whenever the output pulse control circuit 333 counts a prescribed number of internal pulses. In FIG. 19, whenever this output pulse control circuit 333 counts two internal pulse (t5, t6, . . . ), this output pulse control circuit 333 generates one printing timing signal. In other words, the output pulse control circuit 333 outputs a printing signal which yields a resolution of 1440 dpi÷2=720 dpi.

It is to be noted that this output pulse control circuit 333 may be set so that the number of the internal pulses, which determines the generation frequency of the printing timing signal, can be changed by inputting an appropriate selection signal.

The printing timing generating circuit 33 also has a delay counter 334, which sends a printing timing signal to the printing head driving circuit 35 after the printing timing generating circuit 33 has counted the prescribed number of internal pulses and a prescribed count value. In other words, after a start signal, which instructs the printing operation to start, has become a high level signal (t3), this delay counter 334 starts counting down a pre-set delay count value (in FIG. 19, the delay count value is 7) when the first reference pulse has been input (t4), and sends a printing timing signal to the printing head driving circuit 35 when this countdown is finished (t5).

By increasing or decreasing the delay count value which is set to the above-mentioned delay counter 334, after the point in time at which the start signal for instructing the printing to be started has become a high level signal (t3), the time interval between the moment at which the first encoder signal rises, that is, when the reference pulse is generated (t4), and the point in time at which the first printing timing signal is generated (t5), can be changed. Therefore, by changing the time interval for both of the forward direction and the backward direction of the printing head 27, the discrepancy in the relative positional relation between the printing operation in the forward direction and the printing operation in the backward direction of the printing head 27 can be corrected. In this embodiment, the relative positional relation can be corrected for every one period of the internal pulse, that is, at the resolution of 1440 dpi.

Figures 20, 21:
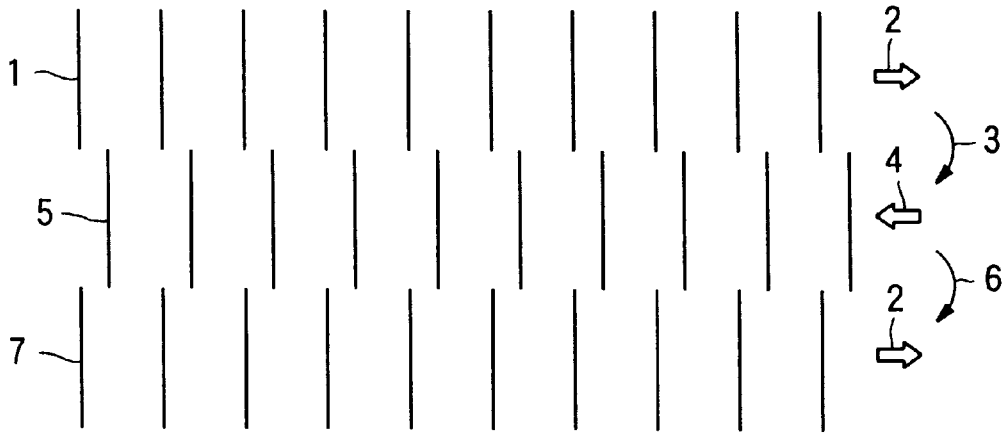
FIG. 20 is a diagram showing a correction amount table 36 that is stored in a correction memory installed in the printing timing generating circuit 33 shown in FIG. 18.
FIG. 21 is a diagram illustrating ruled lines 1, 5 and 7 as judgment patters which are printed on one prescribed sheet of a recording sheet in accordance with the printing position propriety judging method in the related art.
Figure 22:
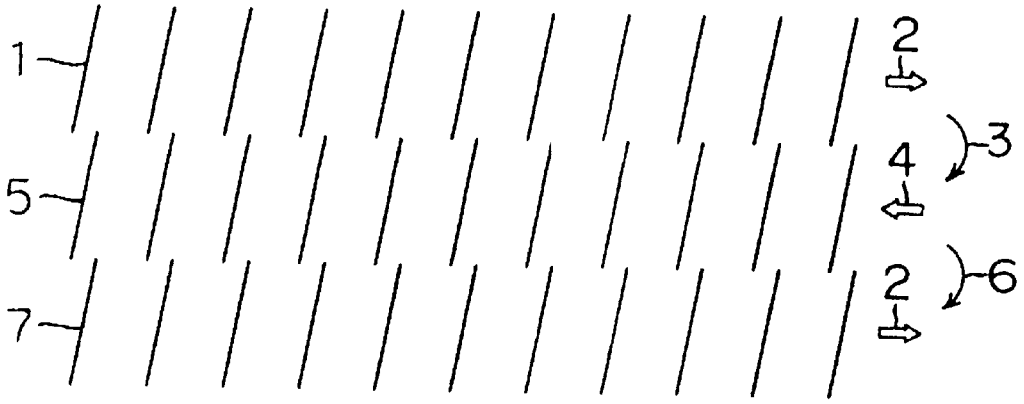
FIG. 22 is a diagram illustrating a printing result of the ruled lines 1, 5 and 7 shown in FIG. 21 in the case in which the printing head is inclined toward the direction of its motion.
Figure 23:
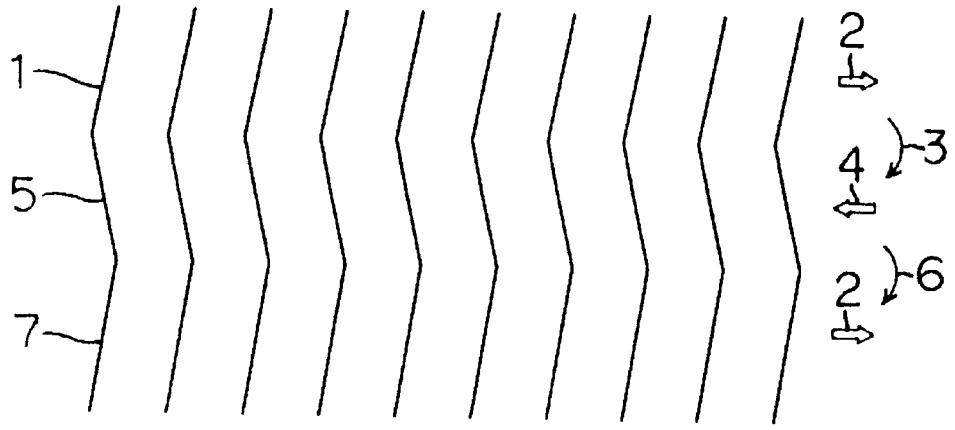
FIG. 23 is a diagram illustrating a printing result of the ruled lines 1, 5 and 7 shown in FIG. 21 in the case in which the head surface of the printing head is not parallel to the recording surface.
Figure 24:
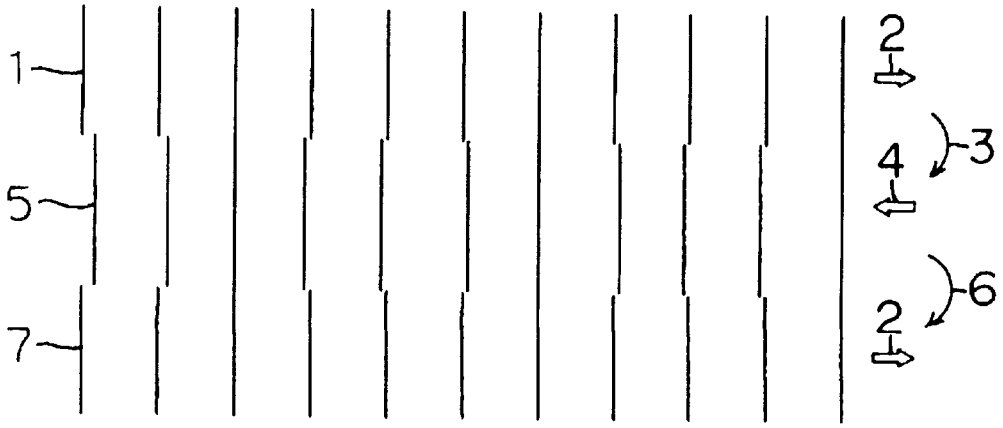
FIG. 24 is a diagram illustrating a printing result of the ruled lines 1, 5 and 7 shown in FIG. 21 in the case in which the velocity of the motion of the printing head is changed.

The non-volatile memory 303 has a correction amount memory 360 for recording the delay count value that is increased or decreased so as to correct the relative positional relation as described above. The ROM 301 contains the judgment pattern data for performing a printing operation for judging the propriety of the printing position to be explained later and the correction amount table 36 (FIG. 20). The correction amount table 36 stores the delay count values which correspond to identification numbers for distinguishing the multiple judgment patters. The correction amount table 36 will be explained in detail later.

Given the above-described background, the method of judging the propriety of the printing position according to an embodiment of the present invention will be explained in the following.

Figure 1:
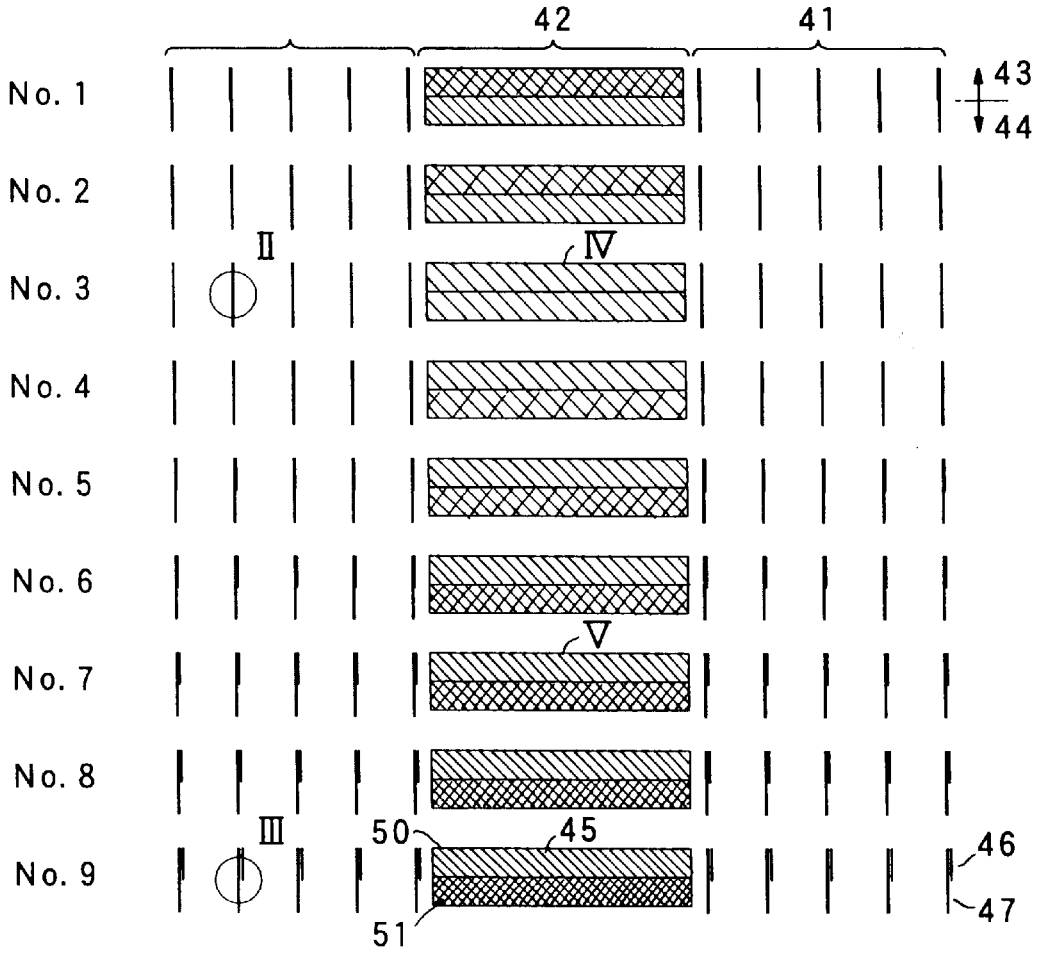
FIG. 1 is a diagram showing several judgment patterns printed on a prescribed recording sheet in accordance with a printing position propriety judging method according to an embodiment of the present invention.

FIG. 1 schematically illustrates the judgment patterns printed on a prescribed sheet of the recording sheet in accordance with the method of judging the propriety of the printing position according to this embodiment of the present invention. Nine kinds of judgment patterns No. 1 through No. 9 are printed on a sheet of the recording sheet, by performing the line feed sequentially. These judgment patterns have been obtained by gradually changing the relative positional relation between the printing operation in the forward direction and the printing operation in the backward direction of the printing head, as will be made clear from an explanation to follow. In FIG. 1, "No. 1" through "No. 9" function as identification codes (identification numbers) for distinguishing the multiple judgment patterns from each other. During the printing process of the judgment patterns, these identification codes are printed corresponding to the position of the respective judgment patters.

Each of the judgment patterns is accommodated within the single row printing range of the printing head, and is constituted of a ruled line pattern part 41 based on the vertical ruled lines and a dot pattern part 42 on which the multiple dots are distributed. The ruled line pattern part 41 is formed on both sides of the dot pattern part 42. The magnified views of the portions II, III, IV and V of FIG. 1 are shown in FIGS. 2, 3, 4 and 5, respectively. The dots shown in FIGS. 2, 3, 4 and 5 have been printed with the ink that the printing head has injected in the format of a dot matrix.

In each of the judgment patterns, both of the ruled line pattern part 41 and the dot pattern part 42 are divided into a first printing region 43 and a second printing region 44, which are located above and below a boundary that extends in the direction of the motion of the printing head, respectively. This boundary is indicated by a boundary line 45 that is printed in the row direction in the dot pattern part 42. However, in the ruled pattern part 41, the boundary is not printed.

In the ruled pattern part 41, a comparison pattern 46 is printed in the first printing region 43 along both directions of the motion of the printing head, and a reference pattern 47 is printed in the second printing region 44 along one direction of the motion of the printing head.

Figure 6A:
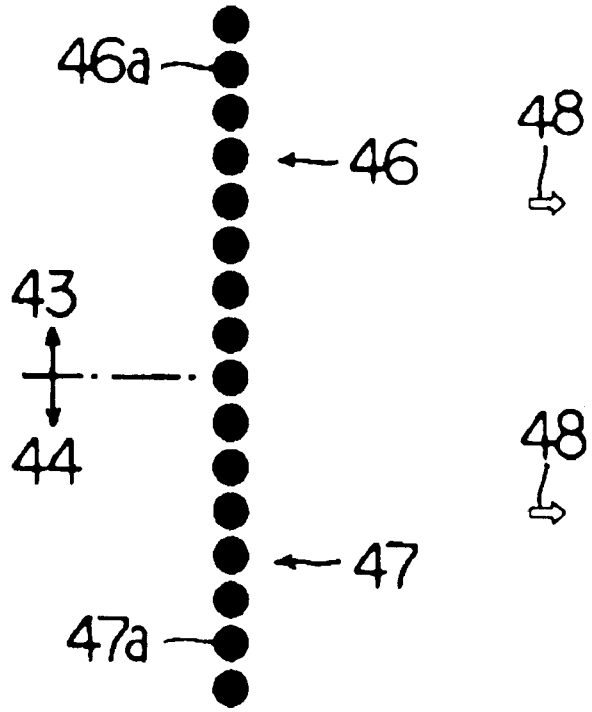
FIG. 6A is one diagram that corresponds to FIG. 2, explaining a printing procedure of a comparison pattern 46 in a ruled line pattern unit 41 shown in FIG. 1 and that of a reference pattern 47 shown in FIG. 1.

This will be explained more specifically with reference to FIGS. 6A and 6B. As shown in FIG. 6A, as the printing head moves in the forward direction 48, multiple dots 46*a* which are to form the comparison pattern 46 are printed in the first printing region 43. At the same time, multiple dots 47*a* which are to constitute the reference pattern 47 are printed in the second printing region 44.

Figure 6B:
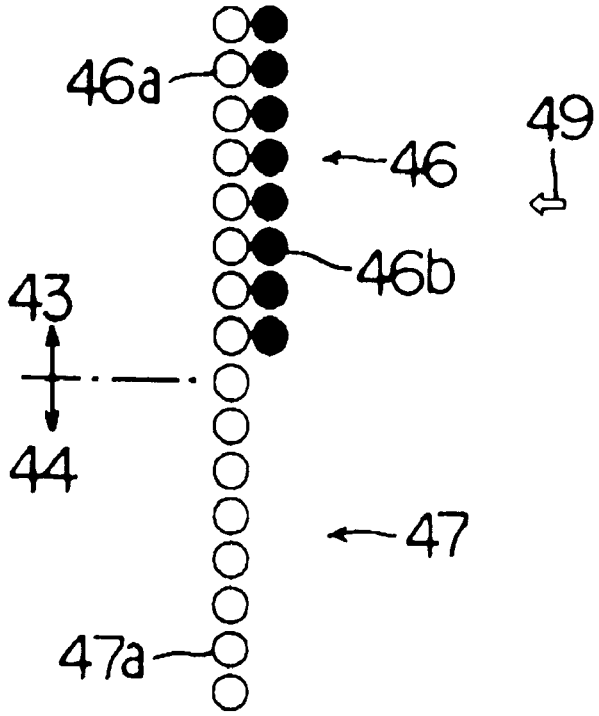
FIG. 6B is another diagram that corresponds to FIG. 2, explaining a printing procedure of a comparison pattern 46 in a ruled line pattern unit 41 shown in FIG. 1 and that of a reference pattern 47 shown in FIG. 1.

Next, as shown in FIG. 6B, as the printing head moves in the backward direction 49, the multiple dots 46*b* which are to form the comparison pattern 46 are printed in the first printing region 43 without changing the row. It should be noted that in FIG. 6B, a circle denotes the dot 46*a* or 47*a* that has been printed in the backward direction 48 shown in FIG. 6A.

In the comparison pattern 46 shown in FIG. 6B, the dots 46*a* printed in the forward direction are displaced from the dots 46*b* printed in the backward direction 49. However, when the relative positional relation between the printing operation in a forward direction 48 and the printing operation in a backward direction 49 is optimal, as the dots 46*b* are printed, the dots 46*b* are completely superposed on the dots 46*a*.

Figure 2:
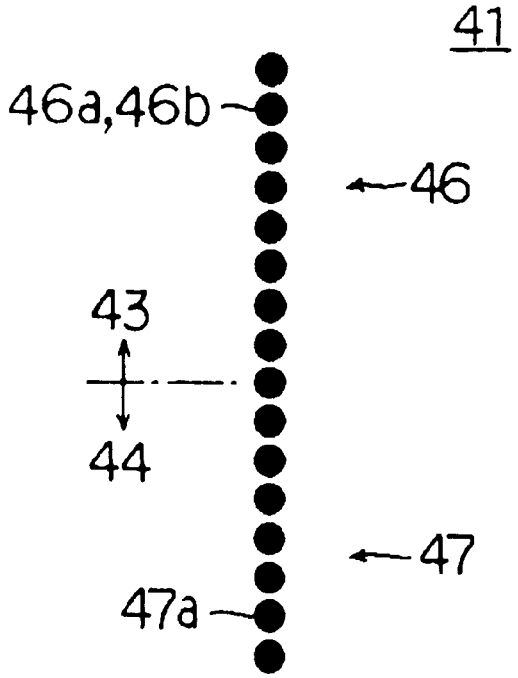
FIG. 2 is a magnified view of a part II shown in FIG. 1.

FIG. 2 shows a state in which the dots 46*a* printed in the forward direction 48 are completely superposed on the dots 46*b* printed in the backward direction 49 in the comparison pattern 46. In this state, the comparison pattern 46 becomes identical to the reference pattern 47. As a result, both of the comparison pattern 46 and the reference pattern 47 provide a series of the ruled lines in uniform thickness.

Figure 3:
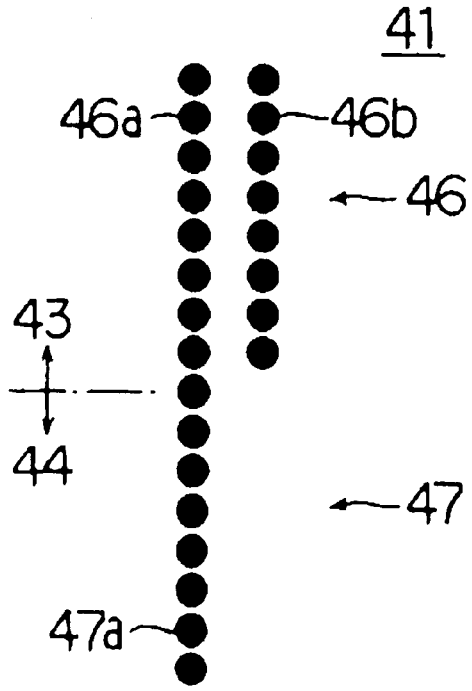
FIG. 3 is a magnified view of a part III shown in FIG. 1.

On the other hand, FIG. 3 shows a state in which the dots 46*a*printed in the forward direction 48 are displaced from the dots 46*b* printed in the backward direction 49 in the comparison pattern 46. This state is created when the relative positional relation between the printing in the forward direction 48 and the printing in the backward direction 49 is improper. In this state, as a series of the ruled lines are generated in the reference pattern 47 and the comparison pattern 46, in a portion of the comparison pattern 46, the series of the ruled lines appear as double lines or thicker lines.

On the other hand, in the dot pattern part 42, a reference pattern 50 is printed in the first printing region 43 in one direction of the motion of the printing head, and a comparison pattern 51 is printed in the second printing region 44 in both directions of the motion of the printing head.

Figure 7A:
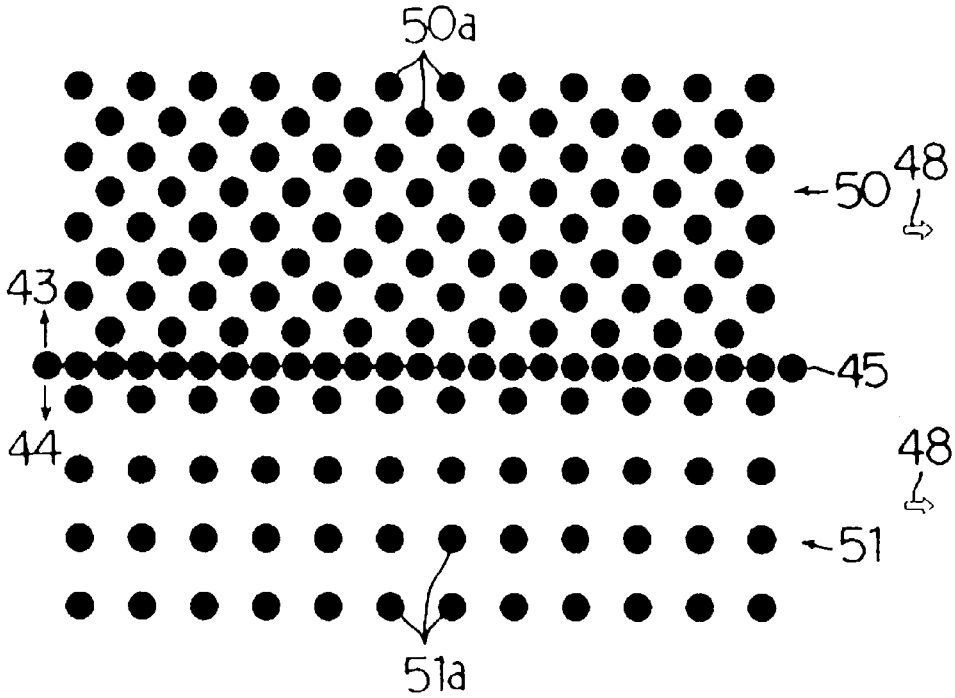
FIG. 7A is one diagram that corresponds to FIG. 4, explaining a printing procedure of a comparison pattern 51 and a reference pattern 50 in a dot pattern unit 42 shown in FIG. 1.

This will be explained more specifically with reference to FIGS. 7A and 7B. First, as shown in FIG. 7A, as the printing head moves in the forward direction 48, multiple dots 50*a* which constitute the reference pattern 50 are printed on the first printing region 43. At the same time, multiple first group dots 51*a* which constitute a portion of the comparison pattern 51 are printed in the second printing region 44.

Figure 7B:
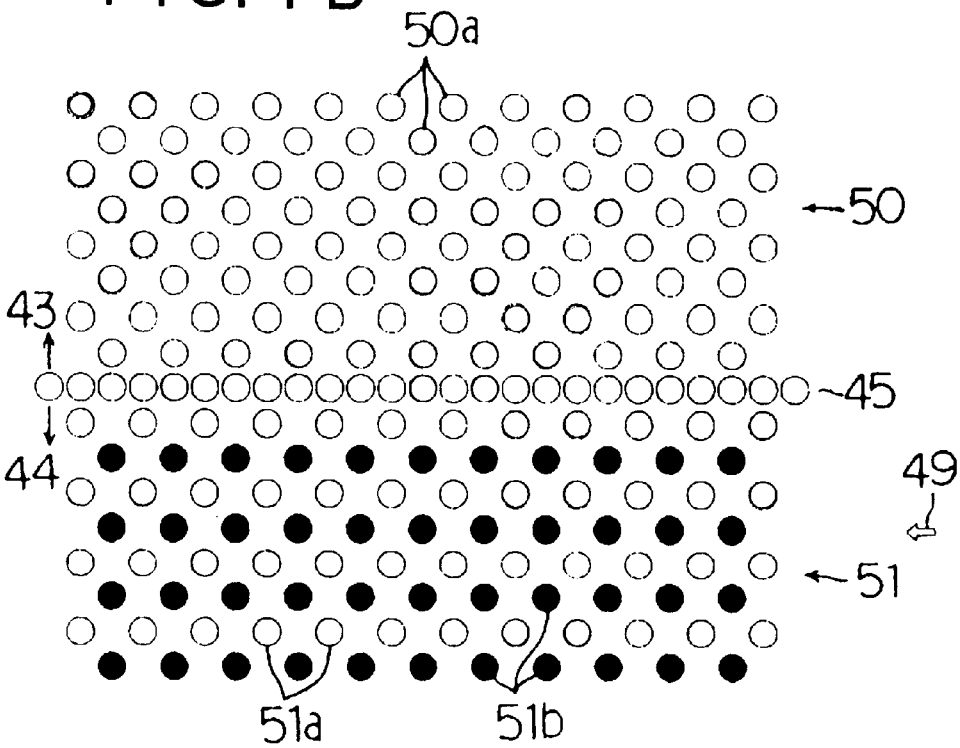
FIG. 7B is another diagram that corresponds to FIG. 4, explaining a printing procedure of a comparison pattern 51 and a reference pattern 50 in the dot pattern unit 42 shown in FIG. 1.

Next, without changing the row, as shown in FIG. 7B, as the printing head moves in the backward direction 49, multiple second group dots 51*b* which constitute the remaining portion of the comparison pattern 51 are printed in the second printing region 44 so that the dots 51*b* will be distributed between successive first group dots 51*a*. It should be noted that in FIG. 7B, O denotes the dot 50*a* or 51*a* that has been printed in the backward direction 48 shown in FIG. 7A.

Figure 4:
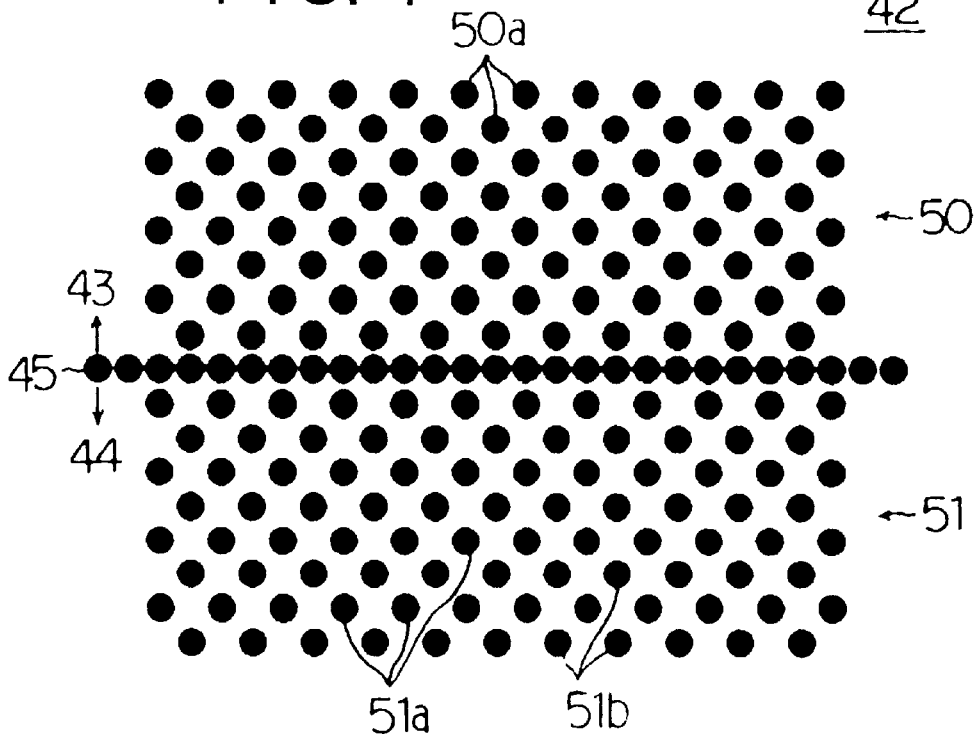
FIG. 4 is a magnified view of a part IV shown in FIG. 1.

FIG. 4 shows a state in which the reference pattern 50 displays exactly the same pattern as the comparison pattern 51. In this state, both of the reference pattern 47 and the comparison pattern 46 display a uniform thin gray pattern having the same concentration. This state is generated when the relative positional relation between the printing operation in the forward direction 48 and the printing operation in the backward direction 49 is optimal.

Figure 5:
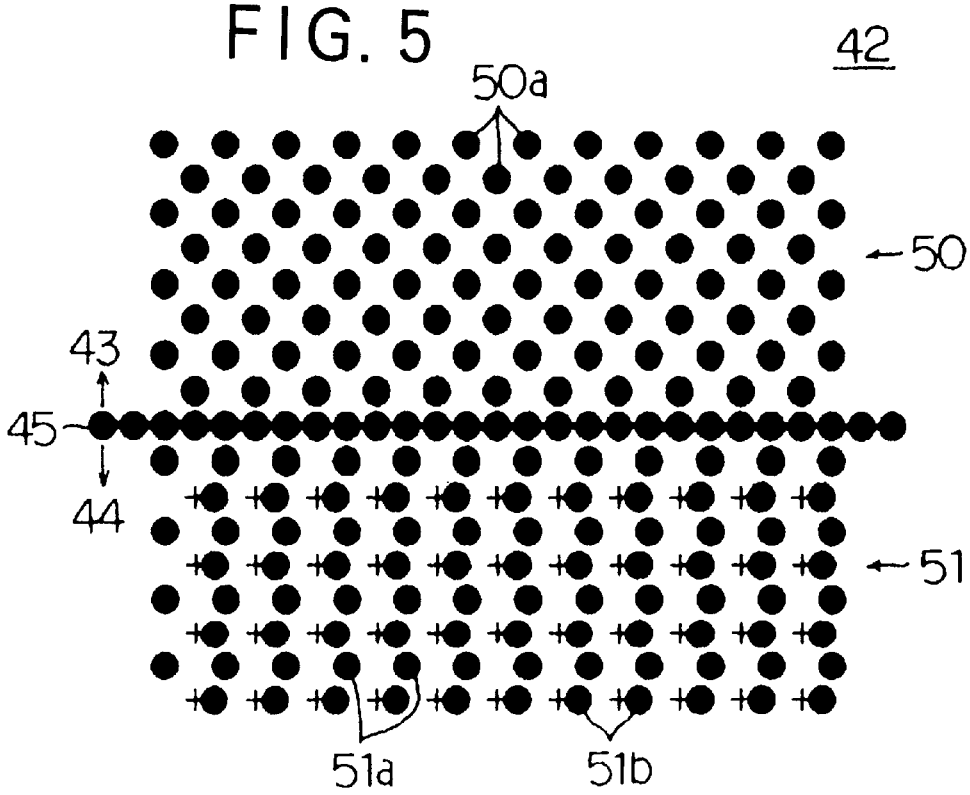
FIG. 5 is a magnified view of a part V shown in FIG. 1.

On the other hand, FIG. 5 shows a state in which the comparison pattern 51 displays a pattern different from the reference pattern 50. This state is generated when the relative positional relation between the printing operation in the forward direction 48 and the printing operation in the backward direction 49 is improper. In this state, a dot pattern generated in the comparison pattern 51 is different from the reference pattern 50. In other words, in FIG. 5, the + are shown in the second printing region 44. Each of these + indicates the position at which the respective second group dot 51*b* should be positioned when the above-mentioned relative positional relation is optimal. As can be seen from FIG. 5, the second group dots 51*b* are displaced from the positions of the +. Therefore, as shown in FIG. 5, when the second group dots 51*b* are displaced from the +, the concentration or pattern that appears in the comparison pattern 51 differs from the one that appears in the reference pattern 50. In a typical case, vertical stripes appear in the comparison pattern 51.

Figure 8:
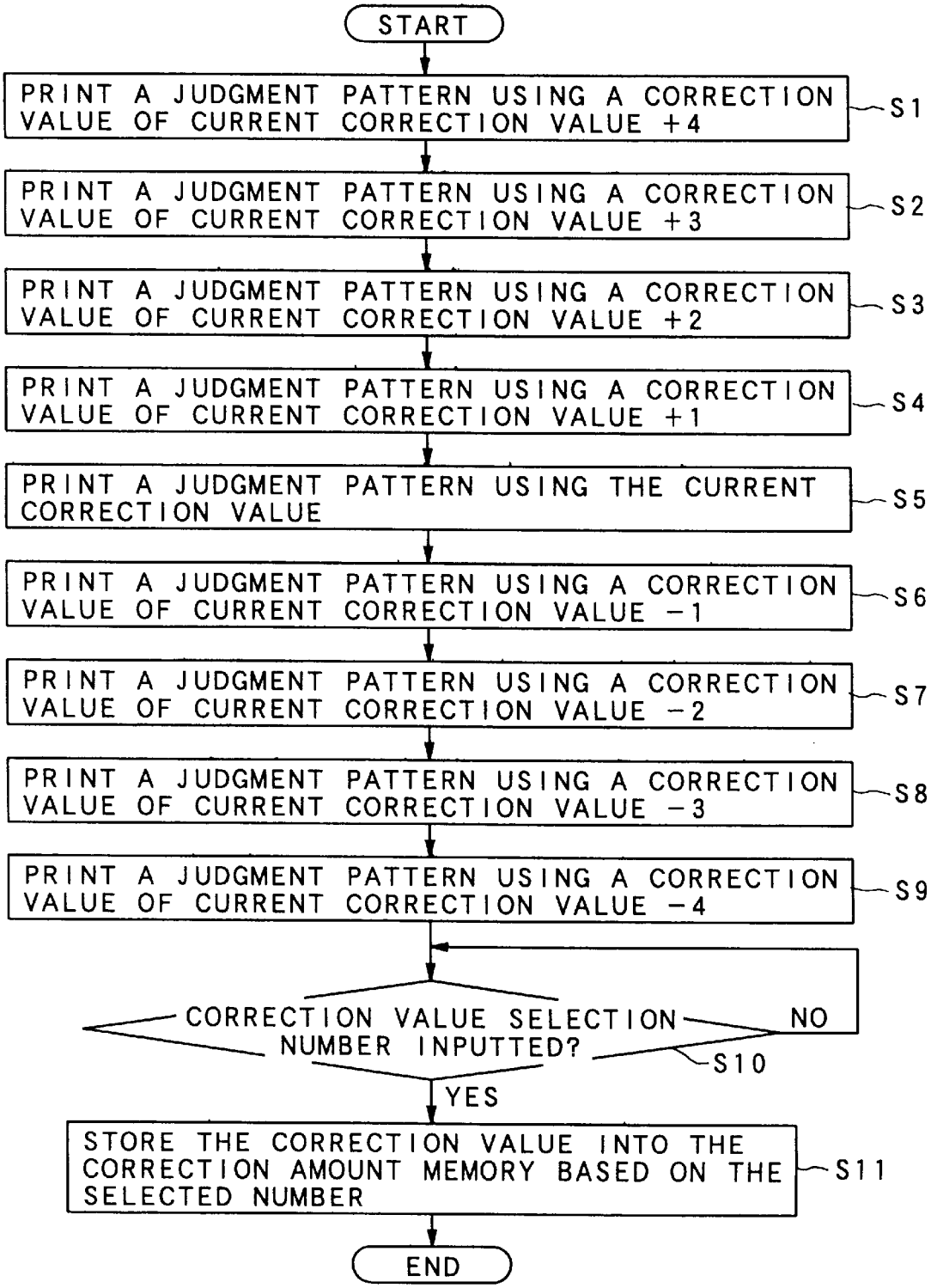
FIG. 8 is a flow chart showing the printing steps of the judgment pattern shown in FIG. 1, and steps of adjusting the relative positional relation between the printing operation in the forward direction and the printing operation in the backward direction that results from the steps of printing the judgment patterns shown in FIG. 1.

FIG. 8 is a flow chart showing the steps of printing the judgment patterns shown in FIG. 1, and the steps of adjusting the relative positional relation between the printing operation in the forward direction and the printing operation in the backward direction that results from the steps of printing the judgment pattern shown in FIG. 1.

The step sequence shown in this flow chart is started, for example, when an operator turns on an input switch 103 on an operation panel 101 installed in the ink jet printing apparatus 11 so as to execute a printing mode for judging the propriety of the relative positional relation between the printing operation in the forward direction of the printing head and that in the backward direction of the printing head.

As has been explained before, the judgment patterns No. 1 through No. 9 shown in FIG. 1 have been obtained by gradually changing the relative positional relation between the printing operation in the forward direction and the printing operation in the backward direction of the printing head. In order to change this relative positional relation, the delay count value set in the delay counter installed in the afore-mentioned printing timing generating circuit 33 (FIG. 18) is increased or decreased.

Therefore, in printing the judgment patterns in the step S S1 through S9 shown in FIG. 8, the correction amounts (these correspond to the number of internal pulses shown in FIG. 19), which range from +4 to −4, for the identification codes No. 1 through No. 9 are sequentially read out from the correction amount table 36 shown in FIG. 20. These correction amounts are then added to the current delay count values stored in the correction amount memory 360 of the non-volatile memory 303, that is, the current correction values. The current delay count values are thus increased or decreased. These corrected current delay count values are then supplied to the delay counter 334 of the printing timing generating circuit 33. As a result, based on the judgment pattern data stored in the ROM 301, the judgment patterns are sequentially printed.

In addition to the above explained method, there are various kinds of methods for regularly changing the judgment patterns within the prescribed range of internal pulse counts without referring to the correction amount table.

When this printing mode is started, in the step S1, using the correction value equal to the current correction value +4, the judgment pattern that corresponds to No. 1 shown in FIG. 1 is printed. As a result, the judgment pattern that corresponds to No. 1 shown in FIG. 1 is obtained.

Next, in the step S2, using the correction value equal to the current correction value +3, the judgment pattern that corresponds to No. 2, shown in FIG. 1 is printed.

Next, in the step S3, using the correction value equal to the current correction value +2, the judgment pattern that corresponds to No. 3, shown in FIG. 1 is printed.

Next, in the step S4, using the correction value equal to the current correction value +1, the judgment pattern that corresponds to No. 4, shown in FIG. 1 is printed.

Next, in the step S5, using the current correction value, the judgment pattern that corresponds to No. 5, shown in FIG. 1 is printed.

Next, in the step S6, using the correction value equal to the current correction value −1, the judgment pattern that corresponds to No. 6, shown in FIG. 1 is printed.

Next, in the step S7, using the correction value equal to the current correction value −2, the judgment pattern that corresponds to No. 7, shown in FIG. 1 is printed.

Next, in the step S8, using the correction value equal to the current correction value −3, the judgment pattern that corresponds to No. 8, shown in FIG. 1 is printed.

Next, in the step S9, using the correction value equal to the current correction value −4, the judgment pattern that corresponds to No. 9, shown in FIG. 1 is printed.

More judgment patterns may be printed by expanding the range of the correction values. Conversely, fewer patterns may be printed.

Next, in the step S10, an optimal correction value is selected. The operator then inputs the code of the optimal correction value, that is, one of No. 1 through No. 9, by turning on the input switch 103 on the operation panel 101. In selecting this optimal correction value, the judgment patterns No. 1 through No. 9 shown in FIG. 1 are visually observed.

More specifically, the ruled line pattern 41 in each of the judgment patterns is visually observed first. The one in which each of the vertical ruled lines constituted of the comparison pattern 46 and the reference pattern 47 is a straight line of uniform thickness is selected.

In this embodiment, No. 3 corresponds to the optimal correction value. However, in practice, when visually observed, the judgment patterns indicated by No. 2 and No. 4 are virtually indistinguishable from the judgment pattern indicated by No. 3, making it difficult for the operator to select the optimal one. In the case in which the accuracy of the relative positional relation between the printing operation in the forward direction and the printing operation in the backward direction is not required to be high, any one of No. 2 through No. 4 may be selected. However, in the case in which the accuracy of the relative positional relation between the printing operation in the forward direction and the printing operation in the backward direction is required to be high, the dot pattern parts 42 are visually observed next.

In visually observing the dot pattern parts 42, the neighborhood of No. 2 through No. 4 are specifically visually observed. A judgment pattern in which the reference pattern 50 and the comparison pattern 51 are identically displayed is then selected. In this embodiment, No. 3 corresponds to this judgment pattern.

In this way, in the step S10, the code No. 3 of the optimal correction value is selected. The operator then designates this code No. 3.

When this code No. 3 has been thus designated, in the step S11, the correction value that corresponds to this selected code No. 3 is added to the correction amount currently stored in the correction amount memory 360. The result is then stored as a new correction amount in the correction amount memory 360, and is also set in the delay counter 334. Based on this new correction value, the printing positions in both of the forward and backward directions are corrected. This correction amount stored in the correction amount memory 360 becomes the basis for the printing start timing in performing subsequent printing operations.

In the above-explained embodiment, in order to judge the propriety of the relative positional relation between the printing operation in the forward direction and the printing operation in the backward direction, the comparison pattern 46 or 51 is compared in contrast with the reference pattern 47 or 50 in both of the ruled line pattern part 46 and the dot pattern part 42. The human eyes can perform a finer judgment by comparing objects in contrast than judging absolutely a single object. Hence, in this respect, according to the present embodiment, the judgment can be rendered more accurately with a higher degree of reliability.

Regarding this matter, according to the above-explained embodiment, the first printing region 42, in which the comparison pattern 46 or reference pattern 50 is printed, is juxtaposed with the second printing region 44, in which the reference pattern 47 or comparison pattern 51 is printed, without a space. Therefore, the comparison patterns 46 and 51 can be compared with the reference patterns 47 and 50, respectively, within a narrow field of view. This also makes the comparison easy, and contributes to an accurate judgment.

In rendering a judgment, the ruled line pattern part 41 and the dot pattern part 42 are used in combination. Therefore, the characteristics of the respective parts can be exploited. In this respect also, a correct judgment can be rendered more accurately. In this embodiment, as has been explained before, the approximate decision is made first by visually observing the ruled line pattern parts 41. The dot pattern parts are then visually observed so as to render the final decision. This has the following significance. That is, the comparison pattern 51 of the dot pattern part 42 generates a large discrepancy between the first group dots and the second group dots. When the discrepancy reaches a prescribed size, the comparison pattern 51 of the dot pattern part 42 can display the same pattern as the reference pattern 50. Therefore, when only the dot pattern parts 42 are visually observed, this state can be mistaken for the optimal state. In contrast, this problem usually does not occur in visually observing the ruled line pattern parts 41. Therefore, it is significant to render an approximate decision by first visually observing the ruled line pattern parts 41.

Moreover, according to this embodiment, the above-described ruled line pattern part 41 and the dot pattern part 42 are accommodated in a single row of each of the judgment patterns. As a result, the printing area can be saved. Hence the recording sheet can be saved as well. In addition, multiple judgment patterns can be printed on a single sheet of the recording sheet.

Moreover, according to this embodiment, since the multiple judgment patterns can be printed on a single sheet of the recording sheet while changing the row or performing the line feed, the multiple judgment patterns can be easily compared with each other by visual observation.

In addition, in this embodiment, when the relative positional relation is improper, the comparison pattern 46 of the ruled line pattern part 41 is printed as lines thicker than the lines of the reference pattern 47 or double lines. Therefore, the two patterns can be easily compared. Furthermore, in this embodiment, the reference patterns 47 and the comparison patterns 46 form a series of vertical ruled lines. Therefore, when the relative positional relation is proper, both of the reference patterns 47 and the comparison patterns 46 generate the vertical ruled lines of uniform thickness. On the other hand, when the relative positional relation is improper, only the portion of the vertical ruled lines that correspond to the comparison patterns 46 appear as thick lines or double lines. Hence, the propriety of the relative positional relation can be judged easily and correctly.

Moreover, each of the reference pattern 50 and the comparison pattern 51 of the dot pattern part 42 in this embodiment is constituted of a distribution of multiple dots. Therefore, the overall display of the reference pattern 50 is compared with that of the comparison pattern 51 on a surface having a prescribed area. As a result, a highly accurate visual judgment can be made. Furthermore, since the overall display of the reference pattern 50 is compared with that of the comparison pattern 51 on a surface having a prescribed area, even if the velocity of the motion of the printing head changes, the decision can be made without difficulty.

In addition, according to this embodiment, in the printing process, as the printing head moves in one direction, a portion of the reference patterns 47 and 50 and a portion of the comparison patterns 46 and 51 are printed. As the printing head moves in the other direction, the remaining portion of the comparison patterns 46 and 51 is printed. Hence, as the printing head reciprocates once, both of the reference patterns 47 and 50 and the comparison patterns 46 and 51 can be printed. As a result, the printing operation for judging the printing position propriety can be carried out efficiently.

Figure 10:
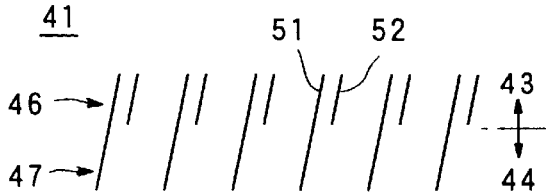
FIG. 10 is a diagram illustrating a printing result of the ruled line pattern unit 41 in the case in which the printing head is inclined toward the direction of its motion in the embodiment shown in FIG. 1.

In the case in which the printing head is inclined in the direction of its motion in this embodiment, as shown in FIG. 10, the comparison pattern 46 and the reference pattern 47 are sometimes printed inclined in the row direction. However, according to the present embodiment, even in the above-described case, the comparison pattern 46 and the reference pattern 47 tilt in the same direction by the same angle. In addition, the ruled line 52 generated by the printing operation in the forward direction in the comparison pattern 46 and the ruled line 53 generated by the printing operation in the backward direction in the comparison pattern 46 also tilt in the same direction by the same angle.

Therefore, no problem occurs in comparing the comparison pattern 46 with the reference pattern 47. In the same way as in the above-described case in which the printing head does not tilt, the comparison pattern 46 can be compared with the reference pattern 47.

Figure 11:
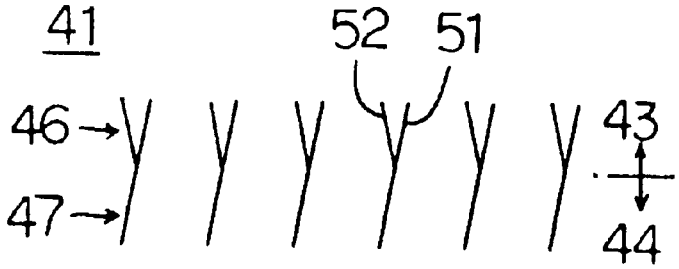
FIG. 11 is a diagram illustrating a printing result of the ruled line pattern unit 41 in the case in which the head surface of the printing head is not parallel to the recording surface in the embodiment shown in FIG. 1.

In the case in which the head surface of the printing head is not parallel to the recording surface, in the ruled line pattern part 41, the ruled line 52 generated by the printing operation in the forward direction in the comparison pattern 46 and the ruled line 53 generated by the printing operation in the backward direction in the comparison pattern 46 tilt in opposite directions. Therefore, as shown in FIG. 11, the printed comparison pattern 46 becomes V-shaped. As a result, the comparison pattern 46 and the reference pattern 47 form a y-shaped pattern. However, even in this case, it is not impossible to compare the thickness or the like of the comparison pattern 46 at the top with that of the reference pattern 47 at the bottom. Therefore, it is possible to select a proper adjustment value.

The states shown in FIGS. 10 and 11, respectively, are illustrated relatively extremely for the sake of explanation. In reality, the comparison pattern 46 and the reference pattern 47 do not tilt to the extent as shown in FIG. 10, and the y-shape does not appear as distinctly as shown in FIG. 11. Therefore, for example, even if the comparison pattern 46 and the reference pattern 47 are printed in a manner shown in FIG. 11, the upper ends of the letter y do not open so extremely as shown in FIG. 11. Hence, it is never impossible to compare the above-mentioned thickness or the like of the comparison pattern 46 at the top with that of the reference pattern 47 at the bottom. If the upper ends of the letter y open so extremely wide as shown in FIG. 11, the printing head is a definite defective. Such a problem cannot be corrected by adjusting the printing position, and thus will not arise at the level of the actual product.

In this embodiment, the operator operates the input switch 103 installed on the operation panel 101 contained in the ink jet printing apparatus 11 so as to print the judgment patterns using the data which represent the increase or decrease in the correction amount or the judgment pattern data stored in the ROM 301. The operator then inputs data for designating appropriate correction values. However, the following alternative method may be used.

The communication interface 100 shown in FIG. 17 can send and receive data to or from the external electronic machine 200. For example, this external electronic machine 200 can be used so as to have the operator order the printing operation of the above-described judgment patterns or the transfer of the judgment pattern data or the correction amount. In this case also, various modified examples can be considered. As an exemplary case, a personal computer (hereafter this will be called a PC) is used as the external electronic machine 200.

As is generally known, software called a driver is operated in a PC. The driver has the function to send data to the apparatus to which the PC is connected and control the data. When a printer is used, this driver transforms the data, which has been created by various applications being executed on the PC, into printable data. The driver then transmits the data to the printer, or transmits a control code for remote-controlling various functions that the printer has from a position removed from the printer main body.

In the present embodiment also, the operator may print the judgment patterns using this driver (printer driver) on the PC, or input the correction amount after the judgment patterns have been printed.

In this case, roughly speaking, the following operation is performed.

First, the operator activates the driver on the PC, selects the printer setting screen using the printer driver, selects the item for correcting the printing timing from the printer setting screen, and has the item executed.

Then, the printer driver first sends a special control command to the ink jet printing apparatus 11 in order to instruct the printer, that is, the ink jet printing apparatus 11, to enter the printing timing correction mode. Subsequently, the printer driver sends the judgment pattern data stored in the memory of the PC, a control code for instructing the ink jet printing apparatus 11 to displace the timing for printing the judgment pattern by a prescribed amount whenever the carriage reciprocates, to the ink jet printing apparatus 11 as many times as needed, together with the printing data of the identification code that corresponds to the data indicating the displacement amount at the time the printing timing is to be displaced. In this case, the displacement amount is changed whenever the carriage reciprocates.

The ink jet printing apparatus 11 receives these data. In the same way the flow shows in FIG. 8, the ink jet printing apparatus 11 then executes the printing operation, and waits for the instruction as for the correction amount. At this stage, the printer driver has finished sending the judgment pattern data and the like to the ink jet printing apparatus 11. The screen display at this stage is ready to receive the input of the code that corresponds to the correction amount. The operator then selects the optimal one from the printed judgment patterns, and inputs the identification code into a prescribed position on this screen. In this case, the printer driver checks the input value, based on the allowable range of input values. If the input value lies outside the range, the printer driver displays an error message, requesting another input value.

If the input value lies inside the prescribed range, the printer driver sends a value that corresponds to the identification code and a control command for updating the currently set correction amount memory and resetting the delay counter based on the value that corresponds to the identification code to the ink jet printing apparatus 11. The printer driver then ends this printing timing correction mode.

The ink jet printing apparatus 11 receives this control code. Then, as has been explained before, the ink jet printing apparatus 11 updates the correction amount memory, resets the delay counter, ends the printing timing correction mode, and prepares for the subsequent printing operation.

In the above explanation, it has been shown that the operator visually observes the judgment patterns. However, this is not the only way.

Recently, printing apparatuses equipped with an image reading apparatus (image scanner) are available. Not only these printing w apparatuses print printing data supplied from an external electronic machine, but also function as copy machines, or image reading machines. The ink jet printing apparatus 11 according to the present embodiment also has an image reading unit 400 as the block diagram in FIG. 17 shows. If this image reading unit 400 has a resolution comparable to the resolution of the printing unit that is determined by the printing head and the like, it is possible to automate the above-explained decision work in which an approximate decision is first rendered based on the ruled line pattern part 41 and then the final decision is made based on the dot pattern part 42.

Figure 9:
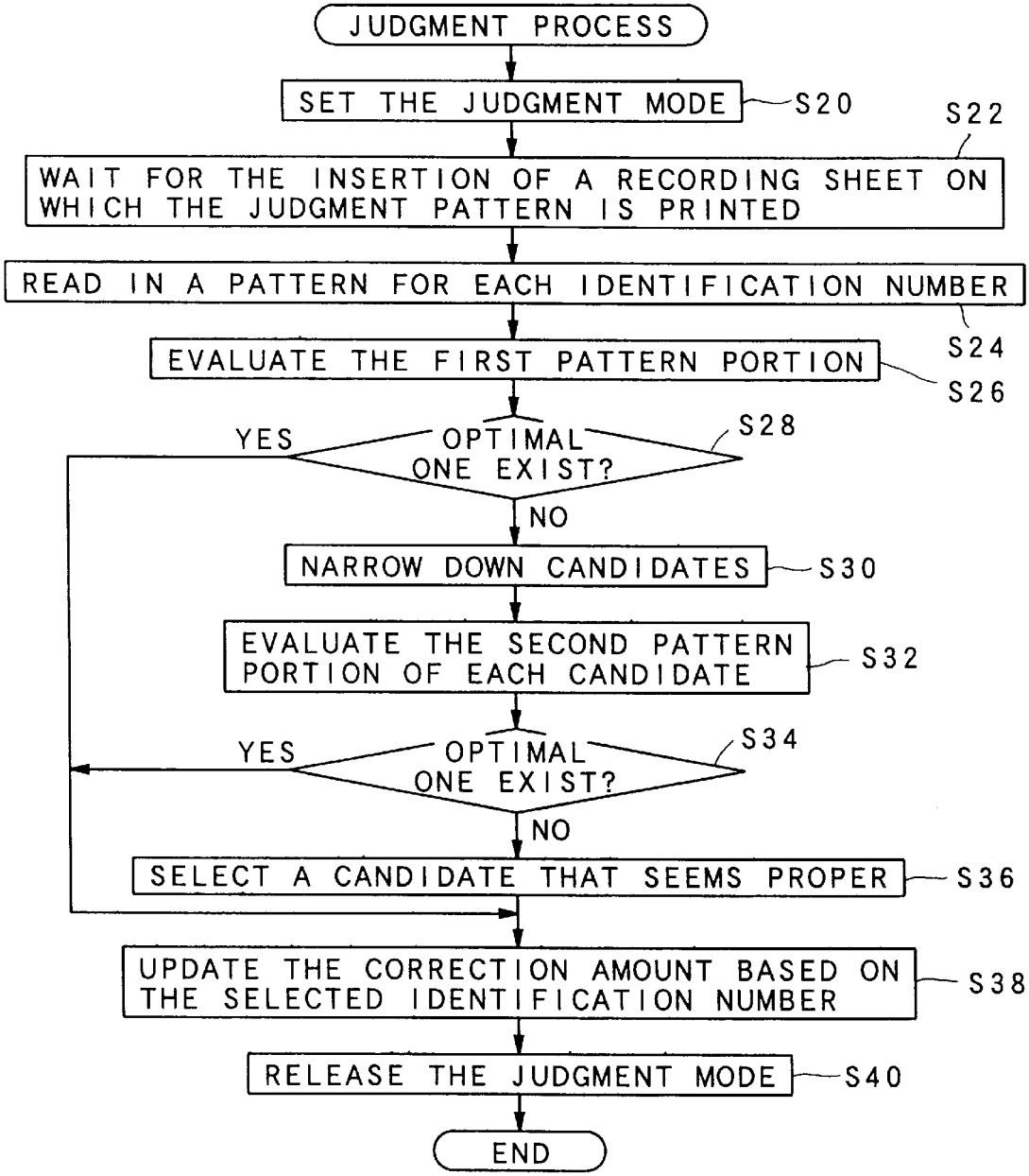
FIG. 9 is a flow chart showing the steps of an automatic judging process in which an image reading unit is used.

In what follows, this automatic decision process that uses the image reading unit 400 will be explained based on the flow chart shown in FIG. 9.

After the judgment patterns have been printed in the above-described manner, the image reading unit 400 installed in the printing apparatus carries out the process this flow chart shows.

First, through the input switch on the operation panel 101, the operator creates a setting for indicating that the standard image readout operation is not in use and the judgment mode is to be activated (S20). Then, the operator inserts the recording sheet on which the judgment patterns are printed into the image reading unit 400 (S22) to have the judgment patterns scanned.

Under the control of the CPU 30, the image reading unit 400 reads out the patterns printed for each identification number, and then stores the patterns into the RAN 302 in a format that the patterns can be read out later for each identification number (S24). In this case, each of the identification numbers is additionally encoded in a barcode, so that the CPU 30 can easily identify the patterns.

Next, for each of the judgment patterns that correspond to the respective scanned identification codes, the comparison pattern part is compared with the reference pattern part. First, based on a first comparison criterion, the first pattern portion is judged. For example, in the ruled line pattern part, the displacements in the scan direction of the upper pattern and the lower pattern are observed, and the difference (average value) between the displacements is obtained. This is carried out for the patterns that correspond to all the identification numbers, and the obtained differences are evaluated (S26).

If the set of the differences does not contain the evident minimum in comparison with the other differences, that is, if two or more differences do not exist inside the prescribed range (Yes in S28), the one having the difference corresponding to the identification number is judged to be the optimal one.

Then the operation is moved to the correction amount setting process.

If the optimal one does not exist (NO in S28), those ones having displacement amounts lying in the prescribed range are selected (S30), and their second pattern portions are judged (S32).

In this case, the comparison may be performed using a second comparison criterion that is different from the above-mentioned first comparison criterion. For example, the dot pattern part 42 is more suitable for comparing the difference between the concentration of the comparison pattern part and that of the reference pattern part than for detecting the displacement amount.

Generally, when the dots are printed, the printing dots represented by 1 do not turn out to be ideal ones having the same size or shape as the non-printing dots represented by 0. Instead, the printed dots tend to be dispersed to some extent. Therefore, even if the same number of dots per unit area are printed, depending on the site on which the dots are printed (inter-dot distance), that is, the state of local distributions of the multiple dots, variation among the local dot distributions arises, generating a non-uniform dot concentration distribution. Taking this characteristic, which arises in printing dots, into consideration, in the dot pattern part 42 of the present embodiment, the printing timing for each of the judgment patterns is displaced from that for the others by a short time interval, providing a fluctuation of some degree to the space between the printed dots.

In contrast, the image readout unit 400 has an A/D converter for converting an input light signal into a digital value. Thus, corresponding to the resolution thereof, the read out value can be inputted as a gray signal having several levels of information per dot. Hence, in reading out the judgment patterns, each of the patterns can be read out as a gray signal and stored into the RAM 302. Then in comparing the dot pattern parts 42, the average of the concentration of a prescribed area of the respective comparison patterns and the concentration of a prescribed area of the reference pattern may be obtained.

In this way, in the second pattern portion also, a comparison is performed based on the difference between the respective comparison pattern part and the reference pattern part (S32), and the optimal one is selected as in the case of the first pattern portion. Here, if all the differences fall into the prescribed range and the optimal one cannot be selected (NO in S34), then the current correction amount is read out from the correction amount memory inside the non-volatile memory 303, and one of the differences which are close to the current correction amount is selected.

Corresponding to the identification number that has been selected in this manner, the correction amount memory is updated, and the delay counter is reset (S38). The printing timing correction process mode is then released (S40), and the standard waiting state is resumed.

In addition, in the above-described step S38, the identification number showing the correction amount to be updated may be displayed on the display unit 102 on the operation panel 101. In this case, the operator confirms the identification number, and then updates the correction amount by sending a confirmation instruction through the input switch 103.

Moreover, in the steps S26 and S32 of the above-explained flow, the value that the image scanner unit has read out has been used for the pattern that serves as a criterion for the comparison. However, as an alternative, the pattern data for printing the pattern held in the ink jet printing apparatus 11 may be used as the criterion.

As another alternative, candidates may be first selected by comparing the dot pattern parts 42, and then the final one may be decided from the ruled line patterns 41.

Figure 12:
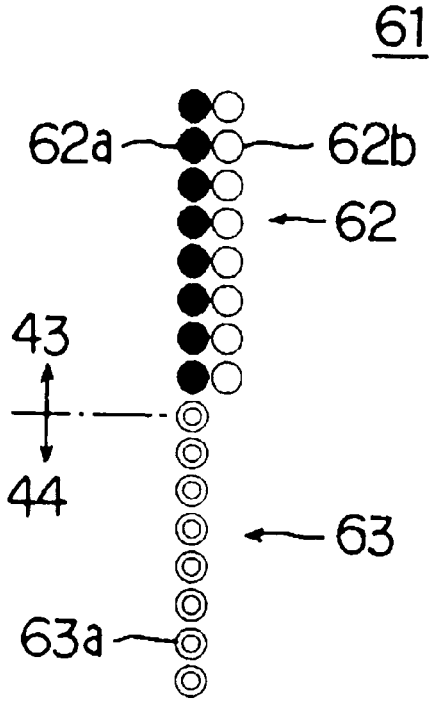
FIG. 12 is a diagram explaining another embodiment of the present invention corresponding to FIG. 2.

FIG. 12 explains another embodiment of the present invention, magnifying a ruled line pattern part 61 that corresponds to the ruled line pattern part 41 of the afore-explained embodiment.

In this embodiment also, a comparison pattern 62 is printed on a first printing region 43 as the printing head moves in both directions. A reference pattern 63 is printed on a second printing region 44 as the printing head moves in one direction. This embodiment is characterized by the following point. Namely, when printing the reference pattern 63, a first color is superposed on a second color that is distinct from the first color as the printing head moves in one direction. When printing the comparison pattern 62, the first color is printed as the printing head moves in the forward direction, and the second color is printed as the printing head moves in the backward direction.

This will be explained more specifically. First, as the printing head moves in the forward direction, multiple dots 62*a* indicated by the black dot (●) forming the comparison pattern 62 are printed with cyan on the first printing region 43. At the same time, multiple dots 63*a* indicated by the a double circle (◎) which are to form the reference pattern 63 are printed on the second printing region 44, for example, with cyan superposed on magenta. Next, without changing the row or without the line feed, multiple dots 62*b* indicated by the circle (○) which are to form the comparison pattern 62 are printed, for example, with magenta on the first printing region 43 as the printing head moves in the backward direction.

It is to be noted that, in a manner converse to the above-described method of using the colors, the dots 62*a* generated by the printing operation in the forward direction, which are to form the comparison pattern 62, may be printed with magenta, and the dots 62*b* generated by the printing operation in the backward direction may be printed with cyan.

In the comparison pattern 62 shown in FIG. 12, the dots 62*a* printed in the forward direction are displaced from the dots 62*b* printed in the backward direction. This state is generated when the relative positional relation between the printing operation in the forward direction and the printing operation in the backward direction is improper. In this state, as in the case of the afore-explained embodiment, a series of vertical ruled lines generated by both of the comparison pattern 62 and the reference pattern 63 appear as double lines or thicker lines in a portion of the comparison pattern 62. Moreover, in this state, in the portion of the comparison pattern 62, the color of cyan is identified independently of the color of magenta. On the other hand, in the portion of the reference pattern 63, the colors of cyan and magenta are blended.

On the other hand, if the relative positional relation between the printing operation in the forward direction and the printing operation in the backward direction is optimal, in the comparison pattern 62, the dots 62*a* printed in the forward direction are completely superposed on the dots 62*b* printed in the backward direction. In this state, a series of vertical ruled lines generated by both of the comparison pattern 62 and the reference pattern 63 appear as lines of uniform thickness. Moreover, in this state, in both of the portion of the reference pattern 63 and the portion of the comparison pattern 62, the colors of cyan and magenta are blended.

Therefore, according to this embodiment, the propriety of the relative positional relation between the printing operation in the forward direction and the printing operation in the backward direction can be judged by the color difference between the comparison pattern 62 and the reference pattern 63 also. As a result, the accuracy and reliability of the judgment is improved. In the above-described embodiment, cyan and magenta are used in combination. This combination has an advantage over other combinations containing another color, that is, yellow or black, in that both of the individual colors and the blend of the colors can be identified easily. However, if this advantage is not needed, any other combination of colors may be used.

Figure 13:
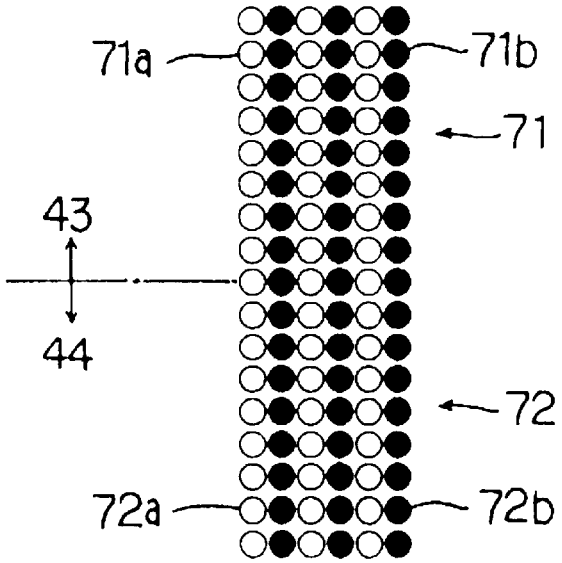
FIG. 13 is a diagram explaining further another embodiment of the present invention corresponding to FIG. 2.

FIG. 13 explains further another embodiment of the present invention. The diagram shown in FIG. 13 corresponds to the magnification drawing shown in the aforementioned FIG. 2, magnifying a reference pattern 71 and a comparison pattern 72.

In this embodiment also, as in the above-explained embodiment shown in FIG. 12, two printing colors are used. However, this embodiment is characterized by the following point. Namely, when printing the reference pattern 71, the first color is juxtaposed with the second color that is distinct from the first color as the printing head moves in one direction. When printing the comparison pattern 72, the first color is printed as the printing head moves in the forward direction, and the second color is printed as the printing head moves in the backward direction.

This will be explained more specifically. First, as the printing head moves in the forward direction, the first group dots 71*a* indicated by the circles (○) that form the reference pattern 71 and the second group dots 71*b* indicated by black dots (●) are printed on the first printing region 43. At the same time, the first group dots 72*a* indicated by the circles (○) that form a portion of the comparison pattern 72 are printed on the second printing region 44. Next, without changing the row or without the line feed, as the printing head moves in the backward direction, dots 72*b* of the second group dots indicated by the black dots (●) that form the remaining portion of the comparison pattern 72 are printed on the second printing region 44.

In the above-described reference pattern 71, the first group dots 71*a* are juxtaposed with the second group dots 71*b*. The first group dots 71*a* are printed in a color different from the color in which the second group dots 71*b* are printed. The first group dots 72*a* of the comparison pattern 72 are printed in the same color that is used to print the first group dots 71*a* of the reference pattern 71. The second group dots 72*b* of the comparison pattern 72 are printed in the same color that is used to print the second group dots 71*b* of the reference pattern 71.

As a combination of these colors, for example, a combination of cyan and magenta is used.

The comparison pattern shown in FIG. 13 displays the same pattern as the reference pattern 71. In other words, in the comparison pattern 72, a state in which the first color is juxtaposed with the second color appears in the same pattern as the reference pattern 71. This display is obtained when the relative positional relation between the printing operation in the forward direction and the printing operation in the backward direction is proper.

On the other hand, when the relative positional relation between the printing operation in the forward direction and the printing operation in the backward direction is improper, a problematic state appears in the comparison pattern 72. For example, at least some of the first group dots 72*a* printed in the first color overlap the second group dots 72*b* printed in the second color. As another example, the size of the gap between the first group dots 72 and the second group dots 72*b* becomes different from the size of the corresponding gap in the reference pattern 71.

Therefore, the propriety of the relative positional relation between the printing operation in the forward direction and the printing operation in the backward direction can be judged on the basis of the color difference or the difference of the degree of color blend between the reference pattern 71 and the comparison pattern 72 also. As a result, the accuracy and reliability of the judgment can be improved.

It should be noted that, in the above-described embodiment also, any other color combination may be used.

Moreover, in the dot pattern part 42 shown in FIG. 1 or the like also, two-color printing such as the one that has been explained with reference to FIG. 13 may be adopted.

This will be explained with reference to FIGS. 7A and 7B. First, as shown in FIG. 7A, as the printing head moves in the forward direction 48, the multiple dots 50*a* that constitute the reference pattern 50 are printed on the first printing region 43. At this time, these dots 50*a* are printed in a first color and a second color that is distinct from the first color. The ones that have been printed in the first color are juxtaposed with the ones that have been printed in the second color. At the same time, in the second printing region 44, the first group multiple dots 51*a* that constitute a portion of the comparison pattern 51 are printed in the first color. Next, without changing the row or without the line feed, as shown in FIG. 7B, as the printing head moves in the backward direction 49, the second group multiple dots 51*b* that constitute the remaining portion of the comparison pattern 51 are printed in the second color on the second printing region 44 so that these dots will be positioned between the first group dots 51*a* respectively that have been printed in the forward direction 48.

Figure 14:
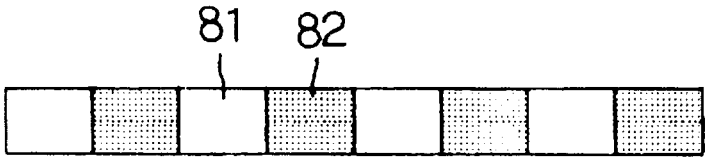
FIG. 14 is a diagram illustrating an arrangement of the printing regions 81 and 82, and explaining the further another embodiment of the present invention.
Figure 15:
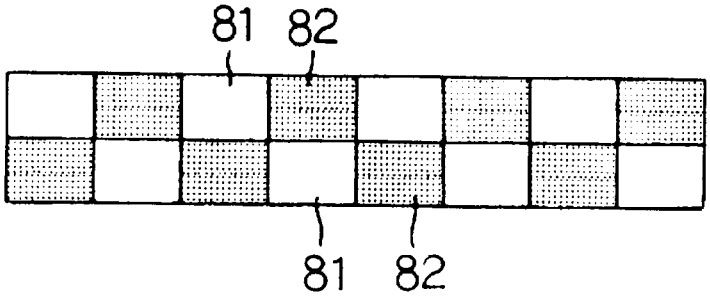
FIG. 15 is a diagram illustrating another arrangement of the printing regions 81 and 82, and explaining the further another embodiment of the present invention.

Each of FIGS. 14 and 15 illustrates further another embodiment of the present invention.

In each of the afore-explained embodiments, the printing region on which the reference pattern is printed and the printing region on which the comparison pattern is printed are separated by the boundary that extends in the direction of the motion of the printing head. However, this position relation between the two printing regions may be changed in the manner shown in FIG. 14 or 15.

In FIG. 14, the printing region 81 on which the reference pattern is printed and the printing region 82 on which the comparison pattern is printed are positioned so that they are arranged in a row. In particular, in this embodiment, the multiple printing regions 81 on each of which the reference pattern is printed and the multiple printing regions 82 on each of which the comparison pattern is printed are positioned alternately.

In FIG. 15, not only the printing region 81 on which the reference pattern is printed and the printing region 82 on which the comparison pattern is printed are arranged in the direction of the motion of the printing head, but also this arrangement is formed in two rows. As a result, the printing region 81 and the printing region 82 are separated by the boundary that extends in the direction of the motion of the printing head also. In other words, the printing region 81 on which the reference pattern is printed and the printing region 82 on which the comparison pattern is printed are arranged not only along the direction of the motion of the printing head but also along the direction orthogonal to this direction of the motion of the printing head.

Particularly, according to the arrangement of the printing region 81 and the printing region 82 shown in FIG. 15, the printing region 81 and the printing region 82 can be compared both in the vertical and horizontal directions. Therefore, even if the difference between the reference pattern and the comparison pattern is small, the difference can be easily identified by visual observation. As a result, the accuracy of the judgment can be further improved.

As has been shown in these FIGS. 14 and 15, even if the position relation between the printing region 81 on which the reference pattern is printed and the printing region 82 on which the comparison pattern is printed is changed, as long as these printing region 81 and the printing region 82 are juxtaposed, the comparison pattern can be easily compared with the reference pattern.

As the reference pattern and the comparison pattern which are printed on the above-described printing regions 81 and 82, respectively, the reference pattern 47 or 50 and the comparison pattern 46 or 51 shown in FIG. 1 or the like, or the reference pattern 63 and the comparison pattern 62 shown in FIG. 12, or the reference pattern 71 and the comparison pattern 72 shown in FIG. 13, or the patterns of other configurations can be applied.

So far, the present invention has been explained with reference to the embodiments shown in the drawings. However, within the scope of the present invention, still other embodiments are possible.

For example, in the embodiment that has been explained with reference to FIG. 1 or the like, the judgment patterns are constituted of the ruled line pattern part 41 based on the vertical ruled lines and the dot pattern part 42 on which the multiple dots are distributed. However, the ruled line pattern part or the dot pattern part may be omitted in order to make the decision based on only one of the two parts.

In the above-discussed embodiment, both of the reference pattern 47 and the comparison pattern 46 generate a series of vertical ruled lines in the ruled line pattern part 41. However, it suffices to generate the comparison pattern so that the part that is printed as the printing head moves in the backward direction is completely superposed on the part that is printed as the printing head moves in the forward direction when the relative positional relation is optimal. Hence, it is possible to devise an embodiment in which the reference pattern and the comparison pattern do not generate a series of vertical ruled lines. Even if the patterns different from the vertical ruled lines are used to generate a reference pattern and a comparison pattern, as in the case of the vertical ruled lines, the comparison pattern can be compared with the reference pattern when the double lines or the lines thicker than the ones that appear in the reference pattern appear in the comparison pattern.

In addition, in the ruled line pattern part 41, when the multiple vertical ruled lines are arranged, the arrangement density of these vertical ruled lines can be changed arbitrarily.

Moreover, in generating the dot pattern part 42, a dot distribution different from the ones shown in the drawings may be adopted.

In the embodiment shown in the drawing, the area of the first printing region 43 on which the comparison pattern 46 and the reference pattern 50 are printed is approximately equal to the area of the second printing region 44 on which the reference pattern 47 and the comparison pattern 51 are printed. However, the area of the first printing region 43 may differ from the area of the second printing region 44.

In addition, in the embodiment shown in the drawing, the comparison pattern 46 and the reference pattern 50 are printed on the first printing region 43, and the reference pattern 47 and the comparison pattern 51 are printed on the second printing region 44. However, the printing regions on which the comparison pattern 46 and the reference pattern 47 are printed may be switched, or the printing regions on which the reference pattern 50 and the comparison pattern 51 are printed may be switched.

In addition, in the embodiment shown in the drawing, while the reference patterns 47 and 50 are printed as the printing head moves in the forward direction, portions of the comparison patterns 46 and 51, respectively, are printed, and the remaining portions of the comparison patterns 46 and 51, respectively, are printed as the printing head moves in the backward direction without changing the row. However, this printing procedure can be changed arbitrarily. For example, the reference patterns 47 and 50 may be printed as the printing head moves in the backward direction. As long as the comparison pattern is printed as the printing head moves in both directions, the row change operation (i.e., the line feeding operation) may be carried out between the printing operation of the comparison pattern and the printing operation of the reference pattern.

Moreover, in the afore-discussed embodiment, in accordance with the flow shown in FIG. 8, as shown in FIG. 1, all the multiple judgment patterns Nos. 1 through 9 are printed. After this, from these judgment patterns corresponding to No. 1 through No. 9, the one in which the reference patterns 47 and 50 optimally approximate the comparison patterns 46 and 51 is selected. The relative positional relation between the printing operation in the forward direction and the printing operation in the backward direction is corrected using the adjustment value that corresponds to the selected judgment patter. However, in place of this procedure, the optimal relative positional relation may be obtained by repeating printing and correcting operations alternately, that is, by printing the first judgment pattern in the current state, correcting the relative positional relation based on this printed first judgment pattern, printing the second judgment pattern based on this corrected relative positional relation, correcting the relative positional relation based on the second judgment pattern and so forth.

Moreover, in the afore-discussed embodiment, the relative positional relation between the printing operation in the forward direction and the printing operation in the backward direction is adjusted by changing the timing delay amount between the time at which the motion of the printing head is started and the time at which the printing operation is started. However, this adjustment method can be changed arbitrarily.

Moreover, in the afore-discussed embodiment, the printing head is intended as an ink jet head. However, the method of judging the propriety of the printing position according to the present invention can be applied to any type of printing head as long as the printing head moves back and forth and performs a printing operation in both of the forward and backward directions. For example, in the case of a wire dot type printing head also, as in the case of the ink jet head, a gap is always formed between the head surface and the recording sheet. Therefore, a time discrepancy is generated between the time at which the printing head starts printing and the time at which the printing is completed on the recording sheet. As a result, the relative positional relation between the printing operation in the forward direction and the printing operation in the backward direction can be displaced. Needless to say, the judging method of the propriety of the printing position according to the present invention can be advantageously applied to this case. For example, even if a thermal type head or an electronic photography type head is used, a delay is generated in transmitting or processing an electric signal. Therefore, this invention can be advantageously applied to these heads also.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 9-133147 filed on May 23, 1997 including the specification, claims, drawings and summary is incorporated herein by reference in its entirety.

What is claimed is:

1. A method of judging a propriety of a relative positional relation between a printing operation in a forward direction and a printing operation in a backward direction on a recording sheet when a printing head of reciprocating type prints in both of the forward and backward directions, said method comprising:

a printing process of printing a reference pattern on one of two printing regions adjacent to each other on the recording sheet, as the printing head moves in one of the forward and backward directions, and printing a comparison pattern, which is to become identical to the reference pattern, on the other of the two printing regions as the printing head moves in both of the forward and backward directions; and a judging process of comparing the printed comparison pattern with the printed reference pattern, judging whether or not the printed comparison pattern is substantially identical to the printed reference pattern on the basis of a predetermined criterion, and judging that the relative positional relation is proper if the printed comparison pattern is judged to be substantially identical to the printed reference pattern.

2. A method of judging a propriety of a relative positional relation between a printing operation in a forward direction and a printing operation in a backward direction on a recording sheet when a printing head of reciprocating type prints in both of the forward and backward directions, said method comprising:

a printing process of printing a reference pattern on one of two printing regions adjacent to each other on the recording sheet, as the printing head moves in one of the forward and backward directions, and printing a comparison pattern, which is to become identical to the reference pattern, on the other of the two printing regions as the printing head moves in both of the forward and backward directions, said printing process being repeatedly performed for a plurality of pairs of the reference pattern and the comparison pattern respectively as the relative positional relation is gradually changed; and a judging process of comparing the printed comparison pattern with the printed reference pattern for each of the pairs, selecting one of the pairs in which the printed comparison pattern optimally approximates the printed reference pattern, and judging that the relative positional relation of the selected one of the pairs is proper.

3. A method according to claim 2, wherein, in the printing process, the pairs are printed on one sheet of the recording sheet such that each of the pairs is printed on respective one of lines on said one sheet while a line feed is performed on said one sheet for each of the pairs.

4. A method according to claim 1, wherein the comparison pattern includes a pattern in which a portion that is printed as the printing head moves in the backward direction is completely superposed onto a portion that is printed as the printing head moves in the forward direction if the relative positional relation is proper.

5. A method according to claim 2, wherein the comparison pattern includes a pattern in which a portion that is printed as the printing head moves in the backward direction is completely superposed onto a portion that is printed as the printing head moves in the forward direction if the relative positional relation is proper.

6. A method according to claim 4, wherein both of the reference pattern and the comparison pattern yield a series of vertical ruled lines.

7. A method according to claim 5, wherein both of the reference pattern and the comparison pattern yield a series of vertical ruled lines.

8. A method according to claim 4, wherein, in the printing process, when printing the reference pattern, a first color and a second color distinct from each other are printed to be superposed with each other as the printing head moves in one of the forward and backward directions; and when printing the comparison pattern, the first color is printed as the printing head moves in the forward direction, and the second color is printed as the printing head moves in the backward direction.

9. A method according to claim 5, wherein, in the printing process, when printing the reference pattern, a first color and a second color distinct from each other are printed to be superposed with each other as the printing head moves in one of the forward and backward directions; and when printing the comparison pattern, the first color is printed as the printing head moves in the forward direction, and the second color is printed as the printing head moves in the backward direction.

10. A method according to claim 1, wherein, in the printing process, when printing the reference pattern, a first color and a second color distinct from each other are printed to be adjacent to each other as the printing head moves in one of the forward and backward directions; and when printing the comparison pattern, the first color is printed as the printing head moves in the forward direction, and the second color is printed as the printing head moves in the backward direction.

11. A method according to claim 2, wherein, in the printing process, when printing the reference pattern, a first color and a second color distinct from each other are printed to be adjacent to each other as the printing head moves in one of the forward and backward directions; and when printing the comparison pattern, the first color is printed as the printing head moves in the forward direction, and the second color is printed as the printing head moves in the backward direction.

12. A method according to claim 1, wherein each of the reference pattern and the comparison pattern includes a pattern on which a plurality of dots are distributed, dots which are included in the comparison pattern being classified into dots in a first group and dots in a second group, the dots in the first group and the dots in the second group being arranged alternately so that each of the dots in the first group is positioned between the dots in the second group and each of the dots in the second group dots is positioned between the dots of the first group, and when printing the comparison pattern, the dots in the first group are printed as the printing head moves in the forward direction and the dots in the second group are printed as the printing head moves in the backward direction.

13. A method according to claim 2, wherein each of the reference pattern and the comparison pattern includes a pattern on which a plurality of dots are distributed, dots which are included in the comparison pattern being classified into dots in a first group and dots in a second group, the dots in the first group and the dots in the second group being arranged alternately so that each of the dots in the first group is positioned between the dots in the second group and each of the dots in the second group dots is positioned between the dots of the first group, and when printing the comparison pattern, the dots in the first group are printed as the printing head moves in the forward direction and the dots in the second group are printed as the printing head moves in the backward direction.

14. A method according to claim 1, wherein, in the printing process, both of the two printing regions are positioned within a printing range of a single line of the printing head, and the comparison pattern is printed as the printing head moves in both of the forward and backward directions without a line feed.

15. A method according to claim 2, wherein, in the printing process, both of the two printing regions are positioned within a printing range of a single line of the printing head, and the comparison pattern is printed as the printing head moves in both of the forward and backward directions without a line feed.

16. A method according to claim 14, wherein, in the printing process, the reference pattern and a portion of the comparison pattern are printed as the printing head moves in one of the forward and backward directions, and a remaining portion of the comparison pattern is printed as the printing head moves in the other of the forward and backward directions.

17. A method according to claim 15, wherein, in the printing process, the reference pattern and a portion of the comparison pattern are printed as the printing head moves in one of the forward and backward directions, and a remaining portion of the comparison pattern is printed as the printing head moves in the other of the forward and backward directions.

18. A method according to claim 1, wherein, in the printing process, a plurality of kinds of pairs of the reference pattern and the comparison pattern are printed.

19. A method according to claim 2, wherein, in the printing process, a plurality of kinds of the pairs of the reference pattern and the comparison pattern are printed.

20. A method according to claim 1, wherein, one of the two printing regions on which the reference pattern is printed and the other of the two printing regions on which the comparison pattern is printed are positioned through a boundary that extends along a direction of a motion of the printing head.

21. A method according to claim 2, wherein, one of the two printing regions on which the reference pattern is printed and the other of the two printing regions on which the comparison pattern is printed are positioned through a boundary that extends along a direction of a motion of the printing head.

22. A method according to claim 1, wherein, one of the two printing regions on which the reference pattern is printed and the other of the two printing regions on which the comparison pattern is printed are positioned to be arranged along a direction of a motion of the printing head.

23. A method according to claim 2, wherein, one of the two printing regions on which the reference pattern is printed and the other of the two printing regions on which the comparison pattern is printed are positioned to be arranged along a direction of a motion of the printing head.

24. A printing apparatus comprising:

a printing head for printing in both of forward and backward directions;

a moving device for moving the printing head so as to reciprocate in the forward and backward directions with respect to a recording sheet; and a printing control device for controlling the printing head and the moving device to print a reference pattern on one of two printing regions adjacent to each other on the recording sheet, as the printing head moves in one of the forward and backward directions, and print a comparison pattern, which is to become identical to the reference pattern, on the other of the two printing regions as the printing head moves in both of the forward and backward directions, when an order to perform a printing operation for judging a propriety of a printing position is given.

25. A printing apparatus comprising:

a printing head for printing in both of forward and backward directions;

a moving device for moving the printing head so as to reciprocate in the forward and backward directions with respect to a recording sheet; and a printing control device for controlling the printing head and the moving device to print a reference pattern on one of two printing regions adjacent to each other on the recording sheet, as the printing head moves in one of the forward and backward directions, and print a comparison pattern, which is to become identical to the reference pattern, on the other of the two printing regions as the printing head moves in both of the forward and backward directions such that printing are repeatedly performed for a plurality of pairs of the reference pattern and the comparison pattern respectively as a relative positional relation between a printing operation in the forward direction and a printing operation in the backward direction is gradually changed, when an order to perform a printing operation for judging a propriety of a printing position of the printing head is given.

26. A printing apparatus according to claim 25, wherein the printing control device controls the printing head and the moving device to print an identification code for each of the plurality of pairs to distinguish the plurality of pairs from each other, and the printing apparatus further comprises a correction device for correcting the printing position for the forward and backward directions, when values corresponding to the identification codes are specified, on the basis of the specified values.

* * * * *